US007878910B2

(12) United States Patent
Wells

(10) Patent No.: US 7,878,910 B2
(45) Date of Patent: Feb. 1, 2011

(54) GAMING MACHINE WITH SCANNING 3-D DISPLAY SYSTEM

(75) Inventor: William R. Wells, Reno, NV (US)

(73) Assignee: IGT, Reno, NV (US)

( * ) Notice: Subject to any disclaimer, the term of this patent is extended or adjusted under 35 U.S.C. 154(b) by 947 days.

(21) Appl. No.: 11/225,966

(22) Filed: Sep. 13, 2005

(65) Prior Publication Data

US 2007/0060390 A1 Mar. 15, 2007

(51) Int. Cl.
*A63F 9/24* (2006.01)

(52) U.S. Cl. ..... 463/46; 463/30; 463/31; 345/7

(58) Field of Classification Search ..... 463/29–34, 463/46; 345/7
See application file for complete search history.

(56) References Cited

U.S. PATENT DOCUMENTS

| | | | |
|---|---|---|---|
| 3,409,351 | A | 11/1968 | Winnek |
| 3,708,219 | A | 1/1973 | Forlini et al. |
| 4,101,210 | A | 7/1978 | Lo et al. |
| 4,333,715 | A | 6/1982 | Brooks |
| 4,607,844 | A | 8/1986 | Fullerton |
| 4,659,182 | A | 4/1987 | Aizawa |
| 4,718,672 | A | 1/1988 | Okada |
| 4,911,449 | A | 3/1990 | Dickinson et al. |
| 4,912,548 | A | 3/1990 | Shanker et al. |
| 4,922,336 | A | 5/1990 | Morton |
| 5,086,354 | A | 2/1992 | Bass et al. |
| 5,113,272 | A | 5/1992 | Reamey |
| 5,152,529 | A | 10/1992 | Okada |
| 5,162,787 | A | 11/1992 | Thompson et al. |
| 5,317,348 | A | 5/1994 | Knize |
| 5,342,047 | A | 8/1994 | Heidel et al. |
| 5,364,100 | A | 11/1994 | Ludlow et al. |
| 5,375,830 | A | 12/1994 | Takemoto et al. |
| 5,376,587 | A | 12/1994 | Buchmann et al. |
| 5,393,061 | A | 2/1995 | Manship et al. |
| 5,395,111 | A | 3/1995 | Inoue |
| 5,467,893 | A | 11/1995 | Landis, II et al. |

(Continued)

FOREIGN PATENT DOCUMENTS

| | | |
|---|---|---|
| EP | 0 454 423 | 10/1991 |

(Continued)

OTHER PUBLICATIONS

Lewis, "In the Eye of the Beholder," IEEE Spectrum, May 2004, pp. 24-28.

(Continued)

*Primary Examiner*—John M Hotaling
*Assistant Examiner*—Allen Chan
(74) *Attorney, Agent, or Firm*—Weaver Austin Villeneuve & Sampson LLP

(57) ABSTRACT

The present invention provides systems and methods that cast an image into a person's eye from a retinal image system included with a gaming machine. The gaming machine includes a retinal image system located within or about the external cabinet and configured to cast an image toward an eye of a person near the gaming machine. The gaming machine also includes an eye detection system configured to locate the eye relative to a position of a projection component of the retinal image system.

45 Claims, 12 Drawing Sheets

U.S. PATENT DOCUMENTS

| | | | | |
|---|---|---|---|---|
| 5,539,547 | A | 7/1996 | Ishii et al. | |
| 5,580,055 | A | 12/1996 | Hagiwara et al. | |
| 5,585,821 | A | 12/1996 | Ishikura et al. | |
| 5,589,980 | A | 12/1996 | Bass et al. | |
| 5,655,961 | A | 8/1997 | Acres et al. | |
| 5,752,881 | A | 5/1998 | Inoue | |
| 5,762,413 | A | 6/1998 | Colucci et al. | |
| 5,764,317 | A | 6/1998 | Sadovnik et al. | |
| 5,801,763 | A * | 9/1998 | Suzuki | 348/77 |
| 5,844,716 | A | 12/1998 | Anderson | |
| 5,850,225 | A | 12/1998 | Cosman | |
| 5,910,046 | A | 6/1999 | Wada et al. | |
| 5,923,469 | A | 7/1999 | Machtig et al. | |
| 5,951,397 | A | 9/1999 | Dickinson | |
| 5,956,180 | A | 9/1999 | Bass et al. | |
| 5,967,893 | A | 10/1999 | Lawrence et al. | |
| 5,993,027 | A | 11/1999 | Yamamoto et al. | |
| 6,001,016 | A | 12/1999 | Walker et al. | |
| 6,008,784 | A | 12/1999 | Acres et al. | |
| 6,015,346 | A | 1/2000 | Bennett | |
| 6,059,658 | A | 5/2000 | Mangano et al. | |
| 6,072,545 | A | 6/2000 | Gribschaw et al. | |
| 6,086,066 | A | 7/2000 | Takeuchi et al. | |
| 6,104,405 | A | 8/2000 | Idaszak et al. | |
| 6,115,006 | A | 9/2000 | Brotz | |
| 6,120,461 | A * | 9/2000 | Smyth | 600/558 |
| 6,135,884 | A | 10/2000 | Hedrick et al. | |
| 6,139,432 | A * | 10/2000 | Watanabe et al. | 463/31 |
| 6,159,098 | A | 12/2000 | Slomiany et al. | |
| D436,469 | S | 1/2001 | Idaszak et al. | |
| 6,177,913 | B1 | 1/2001 | Whitesell | |
| 6,204,832 | B1 * | 3/2001 | Melville et al. | 345/55 |
| 6,208,318 | B1 | 3/2001 | Anderson et al. | |
| 6,208,389 | B1 | 3/2001 | Aben et al. | |
| D440,794 | S | 4/2001 | Zobel, Jr. et al. | |
| 6,213,875 | B1 | 4/2001 | Suzuki | |
| 6,231,189 | B1 | 5/2001 | Colucci et al. | |
| 6,234,900 | B1 * | 5/2001 | Cumbers | 463/29 |
| 6,244,596 | B1 | 6/2001 | Kondratjuk | |
| 6,251,014 | B1 | 6/2001 | Stockdale et al. | |
| 6,252,707 | B1 | 6/2001 | Kleinberger et al. | |
| 6,254,481 | B1 | 7/2001 | Jaffe | |
| 6,315,666 | B1 | 11/2001 | Mastera et al. | |
| 6,322,445 | B1 | 11/2001 | Miller | |
| 6,347,996 | B1 | 2/2002 | Gilmore et al. | |
| 6,368,216 | B1 | 4/2002 | Hedrick et al. | |
| 6,379,244 | B1 | 4/2002 | Sagawa et al. | |
| 6,398,220 | B1 | 6/2002 | Inoue | |
| 6,404,409 | B1 | 6/2002 | Solomon | |
| 6,416,827 | B1 | 7/2002 | Chakrapani et al. | |
| 6,444,496 | B1 | 9/2002 | Edwards et al. | |
| 6,456,262 | B1 * | 9/2002 | Bell | 345/8 |
| 6,491,583 | B1 | 12/2002 | Gauselmann | |
| 6,337,513 | B1 | 1/2003 | Clevenger et al. | |
| 6,503,147 | B1 | 1/2003 | Stockdale et al. | |
| 6,511,375 | B1 | 1/2003 | Kaminkow | |
| 6,512,559 | B1 | 1/2003 | Hashimoto et al. | |
| 6,514,141 | B1 | 2/2003 | Kaminkow et al. | |
| 6,517,432 | B1 | 2/2003 | Jaffe | |
| 6,517,433 | B2 | 2/2003 | Loose et al. | |
| 6,530,667 | B1 | 3/2003 | Idaszak et al. | |
| 6,547,664 | B2 | 4/2003 | Saunders | |
| 6,559,840 | B1 | 5/2003 | Lee | |
| 6,569,018 | B2 | 5/2003 | Jaffe | |
| 6,572,204 | B1 | 6/2003 | Hedrick et al. | |
| 6,573,894 | B1 | 6/2003 | Idaszak et al. | |
| 6,574,047 | B2 | 6/2003 | Hawver | |
| 6,575,541 | B1 | 6/2003 | Hedrick et al. | |
| 6,585,591 | B1 | 7/2003 | Baerlocher et al. | |
| 6,612,927 | B1 | 9/2003 | Slomiany | |
| D480,961 | S | 10/2003 | Deadman | |
| 6,646,695 | B1 | 11/2003 | Gauselmann | |
| 6,652,378 | B2 | 11/2003 | Cannon et al. | |
| 6,659,864 | B2 | 12/2003 | McGahn et al. | |
| 6,661,425 | B1 | 12/2003 | Hiroaki | |
| 6,669,346 | B2 | 12/2003 | Metcalf | |
| 6,695,703 | B1 | 2/2004 | McGahn | |
| 6,702,675 | B2 | 3/2004 | Poole et al. | |
| 6,712,694 | B1 | 3/2004 | Nordman | |
| 6,715,756 | B2 | 4/2004 | Inoue | |
| 6,717,728 | B2 | 4/2004 | Putilin | |
| 6,722,979 | B2 | 4/2004 | Gilmore et al. | |
| 6,753,847 | B2 | 6/2004 | Kurtenbach et al. | |
| 6,755,737 | B2 | 6/2004 | Jackson et al. | |
| 6,802,777 | B2 | 10/2004 | Seelig et al. | |
| 6,817,945 | B2 | 11/2004 | Seelig et al. | |
| 6,817,946 | B2 | 11/2004 | Motegi et al. | |
| 6,832,956 | B1 | 12/2004 | Boyd et al. | |
| 6,857,958 | B2 | 2/2005 | Osawa | |
| 6,866,585 | B2 | 3/2005 | Muir | |
| 6,887,157 | B2 | 5/2005 | LeMay et al. | |
| 6,890,259 | B2 | 5/2005 | Breckner et al. | |
| 6,893,344 | B2 | 5/2005 | Brown et al. | |
| 6,906,762 | B1 | 6/2005 | Witehira | |
| 6,937,298 | B2 | 8/2005 | Okada | |
| 6,939,226 | B1 | 9/2005 | Joshi | |
| 6,954,223 | B2 | 10/2005 | Miyazawa et al. | |
| 7,095,180 | B2 | 8/2006 | Emslie | |
| 7,097,560 | B2 | 8/2006 | Okada | |
| 7,159,865 | B2 | 1/2007 | Okada | |
| 7,160,187 | B2 | 1/2007 | Loose et al. | |
| 7,207,883 | B2 | 4/2007 | Nozaki et al. | |
| 7,220,181 | B2 | 5/2007 | Okada | |
| 7,252,288 | B2 | 8/2007 | Seelig et al. | |
| 7,255,643 | B2 | 8/2007 | Ozaki et al. | |
| 7,297,058 | B2 | 11/2007 | Gomez et al. | |
| 7,309,284 | B2 | 12/2007 | Griswold et al. | |
| 7,322,884 | B2 | 1/2008 | Emori et al. | |
| 7,329,181 | B2 | 2/2008 | Hoshino et al. | |
| 7,439,683 | B2 | 10/2008 | Emslie | |
| 7,505,049 | B2 | 3/2009 | Engel | |
| 7,619,585 | B2 | 11/2009 | Bell | |
| 7,624,339 | B1 | 11/2009 | Engel et al. | |
| 7,626,594 | B1 | 12/2009 | Witehira | |
| 7,724,208 | B1 | 5/2010 | Engel et al. | |
| 7,730,413 | B1 | 6/2010 | Engel | |
| 7,742,124 | B2 | 6/2010 | Bell | |
| 7,742,239 | B2 | 6/2010 | Bell | |
| 2001/0015753 | A1 | 8/2001 | Myers | |
| 2001/0040671 | A1 | 11/2001 | Metcalf | |
| 2001/0048507 | A1 | 12/2001 | Thomas et al. | |
| 2002/0008676 | A1 | 1/2002 | Miyazaki et al. | |
| 2002/0011969 | A1 | 1/2002 | Lipton et al. | |
| 2002/0036825 | A1 | 3/2002 | Lipton et al. | |
| 2002/0067467 | A1 | 6/2002 | Dorval | |
| 2002/0140631 | A1 | 10/2002 | Blundell | |
| 2002/0167637 | A1 | 11/2002 | Burke | |
| 2002/0173354 | A1 | 11/2002 | Winans et al. | |
| 2003/0011535 | A1 | 1/2003 | Kikuchi et al. | |
| 2003/0027624 | A1 | 2/2003 | Gilmore et al. | |
| 2003/0052876 | A1 | 3/2003 | Lee | |
| 2003/0060268 | A1 | 3/2003 | Falconer | |
| 2003/0064781 | A1 | 4/2003 | Muir | |
| 2003/0087690 | A1 | 5/2003 | Loose et al. | |
| 2003/0128427 | A1 | 7/2003 | Kalmanash et al. | |
| 2003/0130028 | A1 | 7/2003 | Aida et al. | |
| 2003/0166417 | A1 * | 9/2003 | Moriyama et al. | 463/46 |
| 2003/0176214 | A1 | 9/2003 | Burak et al. | |
| 2003/0236118 | A1 | 12/2003 | Okada | |
| 2004/0029636 | A1 | 2/2004 | Wells et al. | |
| 2004/0063490 | A1 | 4/2004 | Okada | |
| 2004/0066475 | A1 | 4/2004 | Searle | |
| 2004/0077401 | A1 | 4/2004 | Schlottmann et al. | |
| 2004/0102245 | A1 | 5/2004 | Escalera et al. | |

| | | | |
|---|---|---|---|
| 2004/0116178 | A1 | 6/2004 | Okada |
| 2004/0130501 | A1 | 7/2004 | Kondo et al. |
| 2004/0147303 | A1 | 7/2004 | Imura et al. |
| 2004/0150162 | A1 | 8/2004 | Okada |
| 2004/0162146 | A1 | 8/2004 | Ooto |
| 2004/0166925 | A1 | 8/2004 | Emori et al. |
| 2004/0171423 | A1 | 9/2004 | Silva et al. |
| 2004/0183972 | A1 | 9/2004 | Bell |
| 2004/0192430 | A1 | 9/2004 | Burak et al. |
| 2004/0198485 | A1 | 10/2004 | Loose et al. |
| 2004/0207154 | A1 | 10/2004 | Okada |
| 2004/0209666 | A1 | 10/2004 | Tashiro |
| 2004/0209667 | A1 | 10/2004 | Emori et al. |
| 2004/0209668 | A1 | 10/2004 | Okada |
| 2004/0209671 | A1 | 10/2004 | Okada |
| 2004/0209678 | A1 | 10/2004 | Okada |
| 2004/0209683 | A1 | 10/2004 | Okada |
| 2004/0214635 | A1 | 10/2004 | Okada |
| 2004/0214637 | A1 | 10/2004 | Nonaka |
| 2004/0224747 | A1 | 11/2004 | Okada |
| 2004/0233663 | A1 | 11/2004 | Emslie et al. |
| 2004/0239582 | A1 | 12/2004 | Seymour |
| 2004/0266536 | A1 | 12/2004 | Mattice et al. |
| 2005/0017924 | A1 | 1/2005 | Utt et al. |
| 2005/0032571 | A1 | 2/2005 | Asonuma |
| 2005/0037843 | A1 | 2/2005 | Wells et al. |
| 2005/0049032 | A1 | 3/2005 | Kobayashi |
| 2005/0049046 | A1 | 3/2005 | Kobayashi |
| 2005/0059487 | A1 | 3/2005 | Wilder |
| 2005/0062410 | A1 | 3/2005 | Bell |
| 2005/0062684 | A1 | 3/2005 | Geng |
| 2005/0063055 | A1 | 3/2005 | Engel |
| 2005/0079913 | A1 | 4/2005 | Inamura |
| 2005/0085292 | A1 | 4/2005 | Inamura |
| 2005/0192090 | A1 | 9/2005 | Muir et al. |
| 2005/0206582 | A1 | 9/2005 | Bell et al. |
| 2005/0239539 | A1 | 10/2005 | Inamura |
| 2005/0266912 | A1 | 12/2005 | Sekiguchi |
| 2005/0285337 | A1 | 12/2005 | Durham et al. |
| 2006/0063594 | A1 | 3/2006 | Benbrahim |
| 2006/0103951 | A1 | 5/2006 | Bell |
| 2006/0125745 | A1 | 6/2006 | Evanicky |
| 2006/0191177 | A1 | 8/2006 | Engel |
| 2006/0284574 | A1 | 12/2006 | Emslie et al. |
| 2006/0290594 | A1 | 12/2006 | Engel et al. |
| 2007/0004513 | A1 | 1/2007 | Wells et al. |
| 2007/0026935 | A1 | 2/2007 | Wolf et al. |
| 2007/0026942 | A1 | 2/2007 | Kinsley et al. |
| 2007/0060390 | A1 | 3/2007 | Wells |
| 2007/0072665 | A1 | 3/2007 | Muir |
| 2007/0077986 | A1 | 4/2007 | Loose et al. |
| 2007/0252804 | A1 | 11/2007 | Engel |
| 2009/0104989 | A1 | 4/2009 | Williams et al. |
| 2010/0045601 | A1 | 2/2010 | Engel et al. |
| 2010/0115391 | A1 | 5/2010 | Engel et al. |
| 2010/0115439 | A1 | 5/2010 | Engel |

FOREIGN PATENT DOCUMENTS

| | | |
|---|---|---|
| EP | 0 484 103 | 5/1992 |
| EP | 0 997 857 | 10/1999 |
| EP | 1 063 622 | 12/2000 |
| EP | 1 260 928 | 11/2002 |
| EP | 1 282 088 | 2/2003 |
| EP | 1 462 152 | 9/2004 |
| EP | 1 465 126 | 10/2004 |
| GB | 1 464 896 | 2/1977 |
| JP | 2007-124290 | 5/1995 |
| JP | 2000-300729 | 10/2000 |
| JP | 2000-350805 | 12/2000 |
| JP | 2001-062032 | 3/2001 |
| JP | 2001-238995 | 9/2001 |
| JP | 2001-252393 | 9/2001 |
| JP | 2001-252394 | 9/2001 |
| JP | 2002-085624 | 3/2002 |
| JP | 2004-089707 | 3/2004 |
| JP | 2004-105616 | 4/2004 |
| JP | 2004-166879 | 6/2004 |
| JP | 2004-220276 | 8/2004 |
| JP | 2005-253561 | 9/2005 |
| JP | 2005-266387 | 9/2005 |
| JP | 2005-266388 | 9/2005 |
| JP | 2005-274906 | 10/2005 |
| JP | 2005-274907 | 10/2005 |
| JP | 2005-283864 | 10/2005 |
| JP | 2006-043425 | 2/2006 |
| JP | 2006-059607 | 3/2006 |
| JP | 2006-346226 | 12/2006 |
| JP | 2007-200869 | 8/2007 |
| WO | WO93-13446 | 7/1993 |
| WO | WO99-42889 | 8/1999 |
| WO | WO99-44095 | 9/1999 |
| WO | WO01-09664 | 2/2001 |
| WO | WO01-15127 | 3/2001 |
| WO | WO01-15128 | 3/2001 |
| WO | WO01-15132 | 3/2001 |
| WO | WO01-38926 | 5/2001 |
| WO | WO01/51980 | 7/2001 |
| WO | WO01/76260 | 10/2001 |
| WO | WO02/32521 | 4/2002 |
| WO | WO02/065192 | 8/2002 |
| WO | WO02-084637 | 10/2002 |
| WO | WO02-086610 | 10/2002 |
| WO | WO02-089102 | 11/2002 |
| WO | WO03-001486 | 1/2003 |
| WO | WO03-023491 | 3/2003 |
| WO | WO03-032058 | 4/2003 |
| WO | WO03/039699 | 5/2003 |
| WO | WO03-040820 | 5/2003 |
| WO | WO03-079094 | 10/2003 |
| WO | WO2004-001486 | 12/2003 |
| WO | WO2004-001488 | 12/2003 |
| WO | WO2004-002143 | 12/2003 |
| WO | WO2004-008226 | 1/2004 |
| WO | WO2004-023825 | 3/2004 |
| WO | WO2004-036286 | 4/2004 |
| WO | WO2004-102520 | 11/2004 |
| WO | WO2005/034054 | 4/2005 |
| WO | WO2005/016473 | 5/2005 |
| WO | WO2006/034192 | 3/2006 |
| WO | WO2006-038819 | 4/2006 |
| WO | WO2006-112740 | 10/2006 |
| WO | WO2007-040413 | 4/2007 |
| WO | WO2010-023537 | 3/2010 |

OTHER PUBLICATIONS

Bebis et al., "An Eigenspace Approach to Eye-Gaze Estimation," ISCA 13th International Conference on Parallel and Distributed Computing Systems (Special Session on Digital Video and Digital Audio), pp. 604-609, Las Vegas, 2000.

http://www.seeingmachines.com/facelab.htm website, version 4.2, Sep. 12, 2005.

Ji et al., "An Non-invasive Multi-sensory Technique for Monitoring Human Fatigue," Computer Vision and Robotics Laboratory, Department of Computer Science, University of Nevada, slide presentation, available on Internet Sep. 12, 2005.

U.S. Appl. No. 09/622,409, filed Nov. 6, 2000, Engel, Gabriel.

US Office Action dated Nov. 13, 2006 issued in U.S. Appl. No. 10/661,983.

US Office Action Final dated Mar. 28, 2007 issued in U.S. Appl. No. 10/661,983.

US Office Action dated Jun. 12, 2007 issued in U.S. Appl. No. 10/661,983.

US Office Action Final dated Dec. 11, 2007 issued in U.S. Appl. No. 10/661,983.

US Office Action (Advisory Action) dated Mar. 3, 2008 issued in U.S. Appl. No. 10/661,983.
US Office Action (Examiner Interview Summary) dated May 14, 2008 issued in U.S. Appl. No. 10/661,983.
US Office Action dated Jul. 25, 2008 issued in U.S. Appl. No. 10/661,983.
US Office Action dated Apr. 13, 2009 issued in U.S. Appl. No. 10/661,983.
US Notice of Allowance dated Jan. 13, 2010 issued in U.S. Appl. No. 10/661,983.
US Notice of Allowance dated Apr. 19, 2010 issued in U.S. Appl. No. 10/661,983.
US Office Action dated May 23, 2007 issued in U.S. Appl. No. 10/638,578.
US Office Action dated Dec. 4, 2007 issued in U.S. Appl. No. 10/638,578.
US Office Action Final dated Apr. 17, 2008 issued in U.S. Appl. No. 10/638,578.
US Office Action dated Sep. 30, 2008 issued in U.S. Appl. No. 10/638,578.
US Office Action dated Jun. 24, 2009 issued in U.S. Appl. No. 10/638,578.
US Office Action dated May 28, 2010 issued in U.S. Appl. No. 10/638,578.
US Office Action (Examiner Interview Summary) dated Jun. 3, 2010 issued in 10/638,578 (IGT1P276).
PCT International Search Report dated Feb. 11, 2005 issued in PCT/US2004/028184 (WO2005/034054).
PCT International Preliminary Report on Patentability and Written Opinion dated Mar. 13, 2006 issued in PCT/US2004/028184 (WO2005/034054).
Au Examiner's First Report issued for AU 2004279008 dated Nov. 28, 2008.
PCT International Search Report dated Feb. 22, 2005 issued in PCT/US2004/025132 (W02005/016473).
PCT International Preliminary Report on Patentability and Written Opinion dated Feb. 13, 2006 issued in PCT/US2004/025132 (W02005/016473).
GB Examination Report dated Dec. 19, 2006 issued in GB 0602813.8.
GB Examination Report dated Oct. 22, 2007 issued in GB 0602813.8.
GB Examination Report dated Jan. 7, 2008 issued in GB 0602813.8.
GB Supplementary Examination Report dated Apr. 11, 2008 issued in GB 060813.8.
GB Decision on Hearing dated May 23, 2008 issued in GB 060813.8.
Bebis et al., (2000) "An Eigenspace Approach to Eye-Gaze Estimation," ISCA 13th International Conference on Parallel and Distributed Computing Systems (Special Session on Digital Video and Digital Audio), Las Vegas, 604-609, 6 pages.
Cees Van Berkel, "Image Preparation for 3D-LCD" Dated: Jan. 25, 1999 *SPIE Conference on Stereoscopic Displays*.
Cees Van Berkel and John Clarke., "Characterization & Optimization of 3D-LCD Module Design" Dated: Feb. 11-14, 1997 *SPIE International Conference on Electronic Imaging*.
Ccs Van Berkel and A.R. Frankilin and J.R. Mansell, "Design and Applications of Multiview 3D-LCD", Oct. 1996, *1996 EuroDisplay Conference*, 109-112.
Debut of the Let's Make a Deal Slot Machine (2002), www.letsmakeadeal.com, 1999-2002, downloaded from Internet on Dec. 3, 2002 at http:///www.letsmakeadeal.com/pr0l.htm, 2 pgs.
"Elumens: Vision Series Products' Specifications", Webpage document, 25 pages, ©2000-2001, found at: http://www.elumens.com/technology/downloadable/VisionSeries_Whitepaper31.doc.
"Elumens: 3D Digital Content Creation for the Vision Series", Webpage document, 21 pages, ©2000-2001, found at http://www.elumens.corriltechnology/downloadable/3D_DigitalContentCreation.pdf.
"Elumens Technology", Webpage document, 2 pages, ©2001, found at: http//www.elumens.coni/technology/technology.html.
"Elumens/Hardware/Tru Theta", Webpage document, 2 pages, ©2001, found at: http//www.elumens.com/technology/hardware.html.
"Elumens/Software", Webpage document, 1 page, ©2001, found at: http://elumens.com/technology/software.html.
Games: Super Monkey Ball, Nintendo of America Inc., 2007, http://www.nintendo.com/gamemini?gameid=m-Game-0000-617 (1 page).
Light Valve (2005), www.meko.co.uk, retrieved from the Internet on Nov. 15, 2005 at http://www.meko.co.uk/lightvalve.shtml, 1 page.
Liquid Crystal Display (2005), Wikipedia.org, retrieved from the Internet on Nov. 16, 2005 at http://en.wikipedia.org/wiki/LCD, 6 pgs.
Magnetica: The Official Website from Nintendo of America, 2006, http://magnetica.intendods.com/launch/ (1 page).
SPD (1999), Malvino Inc., retrieved from the Internet on Jul. 19, 1999 at http://www.malvino.com, 10 pgs.
What is SPD? (2002), www.SPD Systems, Inc., retrieved from the Internet on Dec. 4, 2002 at http://www.spd-systems.com/spdq.htm, 2 pgs.
Bonsor, Kevin (2002), "How Smart Windows Will Work," *Hovvstuffvvorks, Inc*. 1998-2002, retrieved from the Internet on Nov. 25, 2002 at http://www.howstuffworks.com/smart-window.htm/printable, 5 pgs.
Bosner, Kevin (2004) "How Smart Windows Work," *HowStuffWorks, Inc*., 1998-2004, retrieved from the Internet on Apr. 1, 2004 at http://www.howstuffworks.com, 9 pgs.
http://www.seeingmachines.com/facelab. htm website, version 4.2, Sep. 12, 2005, 6 pages.
Ji et al., "An Non-invasive Multi-sensory Technique for Monitoring Human Fatigue", Computer Vision and Robotics Laboratory, Department of Computer Science, University of Nevada, slide presentation, available on Internet Sep. 12, 2005, 43 pages.
Lewis (May 2004) "In the Eye of the Beholder", *IEEE Spectrum*, 24-28.
Living in a flat world? Advertisement written by Deep Video Imaging Ltd., published 2000.
Novel 3-D Video Display Technology Developed, News release: Aug. 30, 1996, www.eurekalert.org/summaries/1199.html, printed from Internet Archive using date Sep. 2, 2000.
Saxe et al., "Suspended-Particle Devices," www.refr-spd.corn, retrieved from the Internet on Apr. 1, 2004 at http://www.refr-spd.com, Apr./May 1996, 5 pgs.
"SynthaGram Monitor", SteroGraphics Corporation, website, 5 pages, © 2003. http://www.sterograpics.com/products/synthagram/synthagram.htm.
Teschler, Leland, "'Awesome': Dish-Display System Dazzles CAD Users," Machine Design, © 2000.
"The SynthaGram Handbook", SteroGraphics, 12 pages, Feb. 2003.
Time Multiplexed Optical Shutter (TMOS): A revolutionary Flat Screen Display Technology, www.vea.com/TMOS.html, Apr. 8, 1999, printed from Internet Archive using date Oct. 6, 1999.
Time Multiplexed Optical Shutter (TMOS): A revolutionary Flat Screen Display Technology, www.tralas.com/TMOS.html, Apr. 5, 2001, printed from Internet Archive using date Apr. 11, 2001.
Police 911, retrieved from Wikipedia.org, 2001, on Oct. 28, 2007 at http://en.wikipedia.org/wiki/Police_911.
"VisiouStatiou", Webpage doument, 3 pages, © 2000, found at http://www.elumens.com/products/visionstation.hlml.
"VisionStation (technical specifications)", Webpage doument, 4 pages, © 2000, found at http://www.elumens.com/products/vstechspecs.html.
Woo, Mason et al., "OpenGL® Programming Guide", 3rd Ed., v.1.2, © 1999, pp. 1-25, 93-154 and 663-668.

* cited by examiner

GAMING MACHINE WITH SCANNING 3-D DISPLAY SYSTEM

FIELD OF THE INVENTION

This invention relates to gaming machines and systems used to output visual information. In particular, the invention relates to retinal image systems and methods of projecting images into an eye of a person interacting with a gaming machine.

BACKGROUND OF THE INVENTION

Gaming machines are becoming increasingly sophisticated. Gambling machines that include a computer processor, LCD display and related computer peripheral devices are now the norm in place of older mechanically driven reel displays. Many casinos employ networks of electronically linked gaming machines. Each gaming machine may offer a different game stored as software in memory included with the gaming machine.

Player participation increases with entertainment. Gaming machines are still limited to flat panel display technology, which limits how information is presented to a player and limits the level (and types) of interaction between the player and game. New and more entertaining forms of interaction between a player and gaming machine would have value.

SUMMARY OF THE INVENTION

The present invention provides systems and methods that cast an image into a person's eye from a retinal image system included with a gaming machine. The gaming machine also includes an eye detection system that detects and locates the person's eye, and tracks the eye over time if desired.

In one embodiment, the eye detection system includes a camera that captures an image of a player's eye. A processing system then locates the eye in the image using video information captured in the image. The processing system may also determine relative positioning between the eye and the gaming machine.

People and their eyes do not remain motionless. Heads rotate and tilt; eyes shift to different parts of the gaming machine. For extended interaction, the eye tracking system also performs 'gaze tracking', which accommodates multiple degrees of freedom for eye location and tracks the eye despite various movements. One or more 2-D or 3-D images may then be cast based on the moving eye location.

A tracking zone may also be built that estimates likely position of the eye. The tracking zone may rely on one or more ergonomic relationships between the person and gaming machine during interaction between the two.

In one aspect, the present invention relates to a gaming machine. The gaming machine comprises an external cabinet defining an interior region of the gaming machine. The external cabinet is adapted to house a plurality of gaming machine components within or about the interior region. The gaming machine also comprises an eye detection system located within or about the external cabinet. The eye detection system locates an eye of a person near the gaming machine, and generates image casting information that describes a position of the eye. The gaming machine further comprises a retinal image system located within or about the external cabinet. The retinal image system generates an image for the person and directs the image into the eye of the person using the image casting information.

In another aspect, the present invention relates to a gaming machine including a retinal image system. The retinal image system includes one or more light sources that generate light. The retinal image system also includes a light valve configured to produce an image by selectively transmitting light according to video information. The retinal image system further includes a projection system that receives the image and transmits the image toward the eye of the person.

In yet another aspect, the present invention relates to a gaming machine including an eye detection system. The eye detection system locates an eye of a person relative to a position of a projection component of a retinal image system. The eye detection system includes a camera configured to capture an image that includes the eye of the person when the person is near the gaming machine. The eye detection system also includes a processing system configured to locate the eye using information captured in the image.

In another aspect, the present invention relates to a method for providing an image to a person near a gaming machine. The method comprises locating an eye of the person relative to a portion the gaming machine. The method also comprises, using a retinal image system, directing the image into the eye of the person according to the location of the eye.

These and other features and advantages of the invention will be described in more detail below with reference to the associated figures.

DESCRIPTION OF THE PREFERRED EMBODIMENTS

Figure 1A:
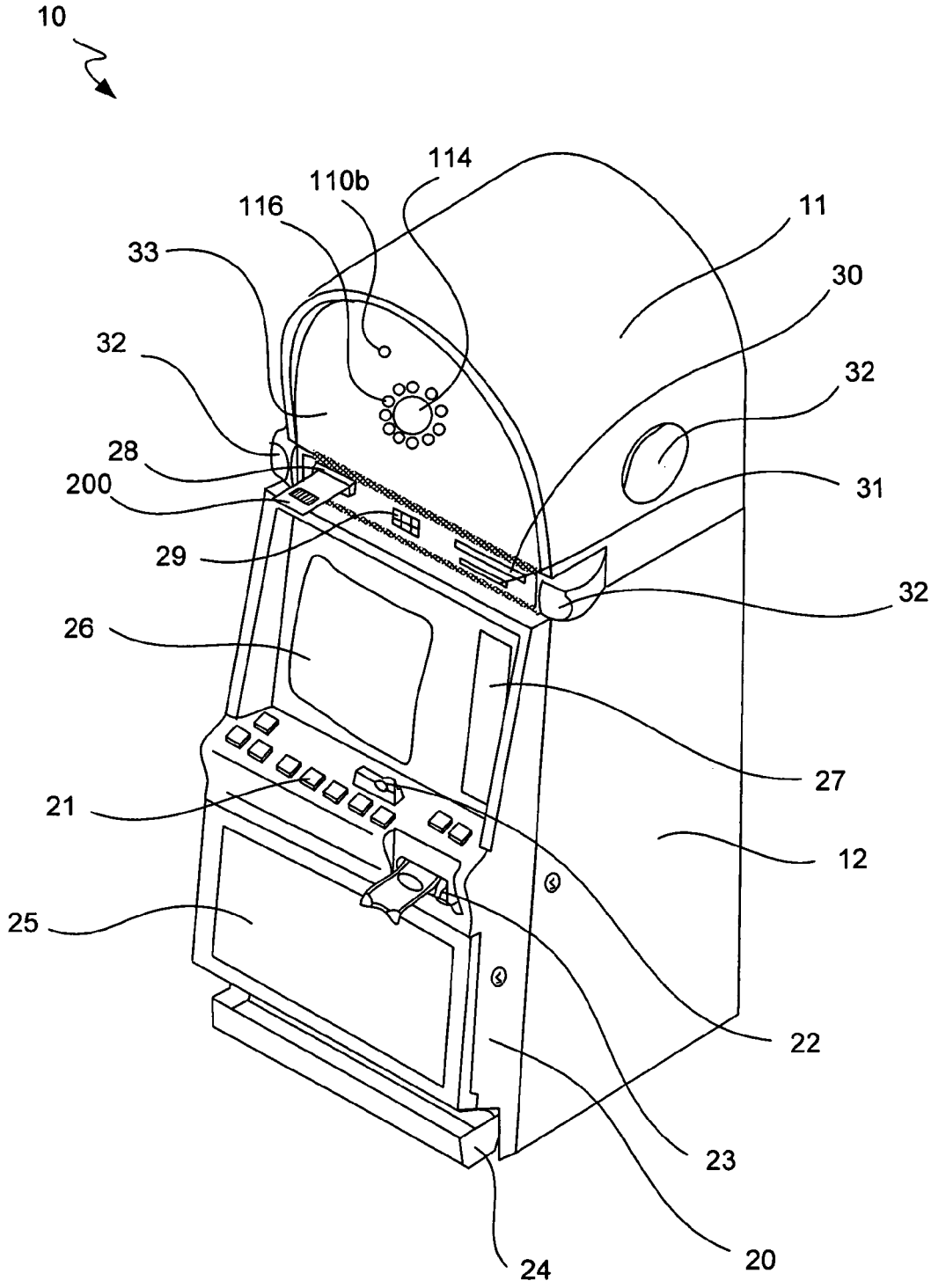
FIG. 1A illustrates an exemplary gaming machine in perspective view according to one embodiment of the present invention.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Overview

The present invention relates to a gaming machine that includes a retinal image system. The retinal image system casts an image into the eye of a player. The image light passes through the pupil and the eye's lens focuses the incoming light onto the retina, which operates as a physiological light sensor for human vision The retinal image system a) locates an eye of the person, and b) adapts projection (e.g., projection direction) based on the current location of the eye. Eye locating may rely on known or assumed information based on the interaction between a player and a gaming machine. For example, it is expected that a person remains within a finite area when interacting with a gaming machine. Eye locating and image casting may also be repeated according to a refresh rate of video information being cast.

In one embodiment, the retinal image system comprises one or more light sources, a light valve, and a projection system. The light sources generate light. The light valve, such as a MEMs micromirror device, selectively transmits light produced by the light source according to video information provided to the light valve. The projection system receives an image created by the light valve and casts the image into the person's eye. In one embodiment, the projection system raster scans the image onto the person's eye. Some designs include a dynamic refocus, which allows the retinal image system to vary depth of perception of visual information, cast images that simulate near and distant objects, and cast 2-D and 3-D images.

In one embodiment, the retinal image system is relatively small and mounted close to the main display of the gaming machine so that an image cast into the player's eye overlays an image on the main game display. Overlay in this sense refers to the retinal image linearly aligning according to viewer perception with an image output by the main display.

The image cast into the person's eye may include any information related to game play on—or interaction with—a gaming machine. In one embodiment, the retinal image system casts bonus game information directly into the eye of a player. In another embodiment, the retinal image system casts 3-D information to enhance game play on a main screen. For example, the 3-D information may relate to 3-D effects that augment graphical output of a game presented on the main screen. The information may also include offers presented by a casino that operates the gaming machine.

One feature of the invention is that information cast into a player's eye can only be seen by that person—and is private to that person only. This allows confidential, personal or privileged information to be provided from the gaming machine to the player without awareness by those around the player or gaming machine. For example, an image cast into the person's eye may include an exclusive offer for tickets to a show, where nobody but the player and the offering establishment is aware of the offer. When combined with player tracking capabilities of conventional gaming systems, the present invention allows new techniques for communicating private offers and other information from a gaming machine to a player.

Gaming Machine

Figure 1B:
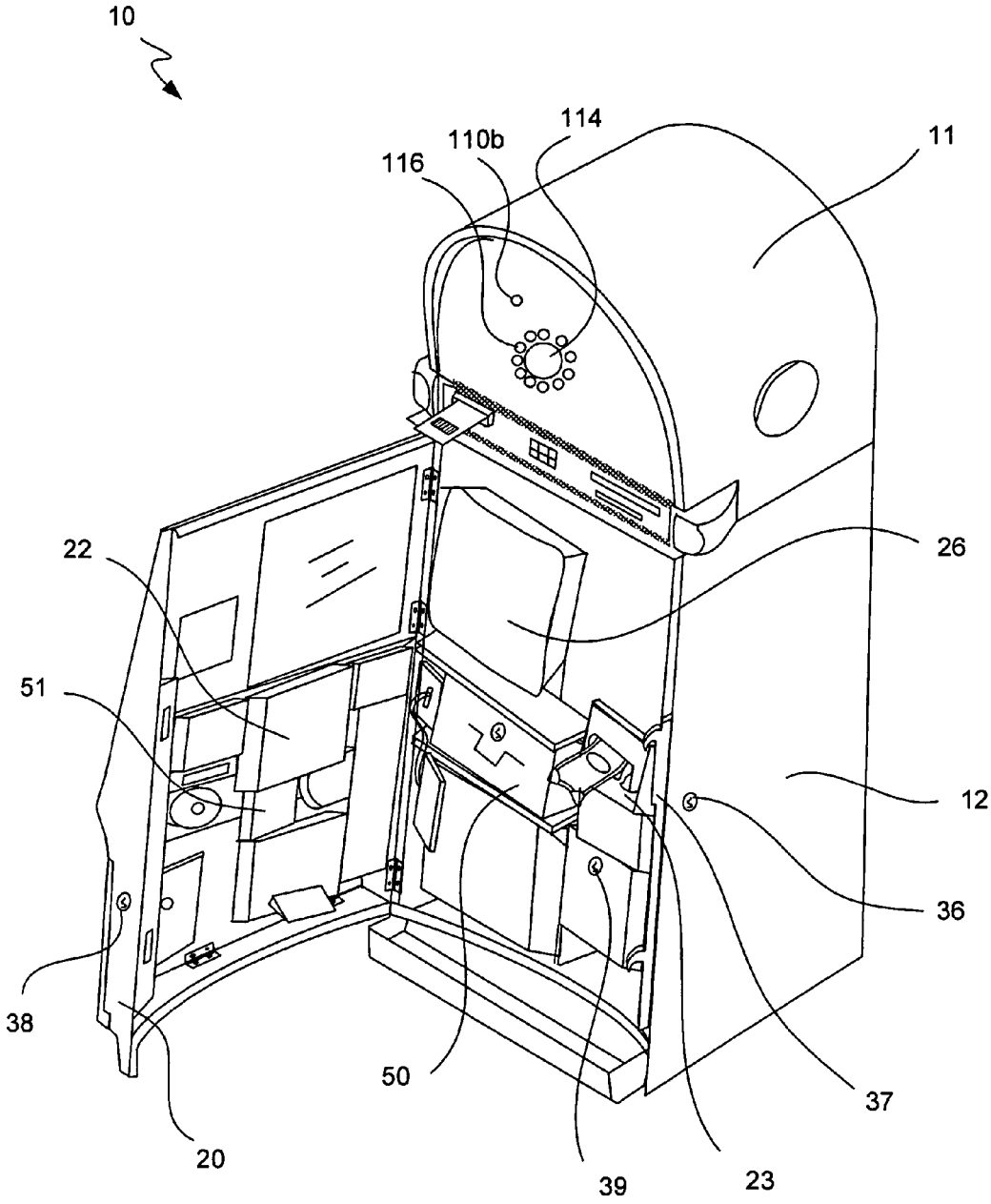
FIG. 1B illustrates in perspective view the gaming machine of FIG. 1A having an opened door.

The present invention may employ a wide variety of gaming machines. For example, the present invention may be used with a gaming machine provided by IGT of Reno, Nev. Gaming machines from other manufacturers may also employ a retinal image system. Referring to FIGS. 1A and 1B, an exemplary gaming machine 10 for use according to one embodiment of the present invention is illustrated in perspective view.

Gaming machine 10 includes a top box 11 and a main cabinet 12, which generally surrounds the machine interior and is viewable by users. Main cabinet 12 includes a main door 20 on the front of the machine, which opens to provide access to the interior of the machine. Attached to the main door are typically one or more player-input switches or buttons 21; one or more money or credit acceptors, such as a coin acceptor 22, and a bill or ticket scanner 23; a coin tray 24; and a belly glass 25. Viewable through main door 20 is a primary video display monitor 26 and one or more information panels 27. The primary video display monitor 26 may include a cathode ray tube, flat-panel LCD, plasma/LED display or other conventional electronically controlled video display.

Top box 11, which typically rests atop of the main cabinet 12, may also contain a ticket printer 28, a key pad 29, one or more additional displays 30, a card reader 31, one or more speakers 32, a top glass 33, one or more cameras 114, one or more eye illuminators 116, and image projection optics 110*b* included in a retinal image projection system. Other components and combinations are also possible, as is the ability of the top box to contain one or more items traditionally reserved for main cabinet locations, and vice versa.

It will be readily understood that gaming machine 10 can be adapted for presenting and playing any of a number of games and gaming events, particularly games of chance involving a player wager and potential monetary payout, such as, for example, a wager on a sporting event or general play as a slot machine game, a keno game, a video poker game, a video blackjack game, and/or any other video table game, among others. While gaming machine 10 is usually adapted for live game play with a physically present player, it is also contemplated that such a gaming machine may also be adapted for remote game play with a player at a remote gaming terminal. Such an adaptation preferably involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or gaming terminal, in that all processing may be done at a remote server, with only the external housing, displays, and pertinent inputs and outputs being available to a player. Further, it is also worth noting that the term "gaming machine" may also refer to a wide variety of gaming devices in addition to traditional free standing gaming machines. Such other gaming machines can include kiosks, set-top boxes for use with televisions in hotel rooms and elsewhere, and many server based systems that permit players to log in and play remotely, such as at a personal computer or PDA. All such gaming devices can be considered "gaming machines" for purposes of the present invention and following discussion, with all of the disclosed metering techniques and devices being adaptable for such uses of alternative gaming machines and devices.

With reference to FIG. 1B, the gaming machine of FIG. 1A is illustrated in perspective view with its main door opened. In additional to the various exterior items described above, such as top box 11, main cabinet 12 and primary video display monitor 26, gaming machine 10 also comprises a variety of internal components. As will be readily understood by those skilled in the art, gaming machine 10 contains a variety of locks and mechanisms, such as main door lock 36 and latch 37. Other locks 38, 39 on various other machine components can also be seen. Internal portions of coin acceptor 22 and bill or ticket scanner 23 can also be seen, along with the physical meters associated with these peripheral devices. Processing system 50 includes computer architecture for interacting with and implementing a retinal image system, as will be discussed in further detail below.

When a person wishes to play a gaming machine 10, he or she provides coins, cash or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a video display. Usually, during the course of a game, a player is required to make a number of decisions that affect the outcome of the game. The player makes these choices using a set of player-input switches.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device may be stored in a memory device provided on a gaming machine network (e.g., a memory device associated with validation terminal and/or processing system in the network). Any credit on some devices may be used for further games on other gaming machines 10. Alternatively, the player may redeem the device at a designated change booth or pay machine.

Retinal Image System

Figure 2:
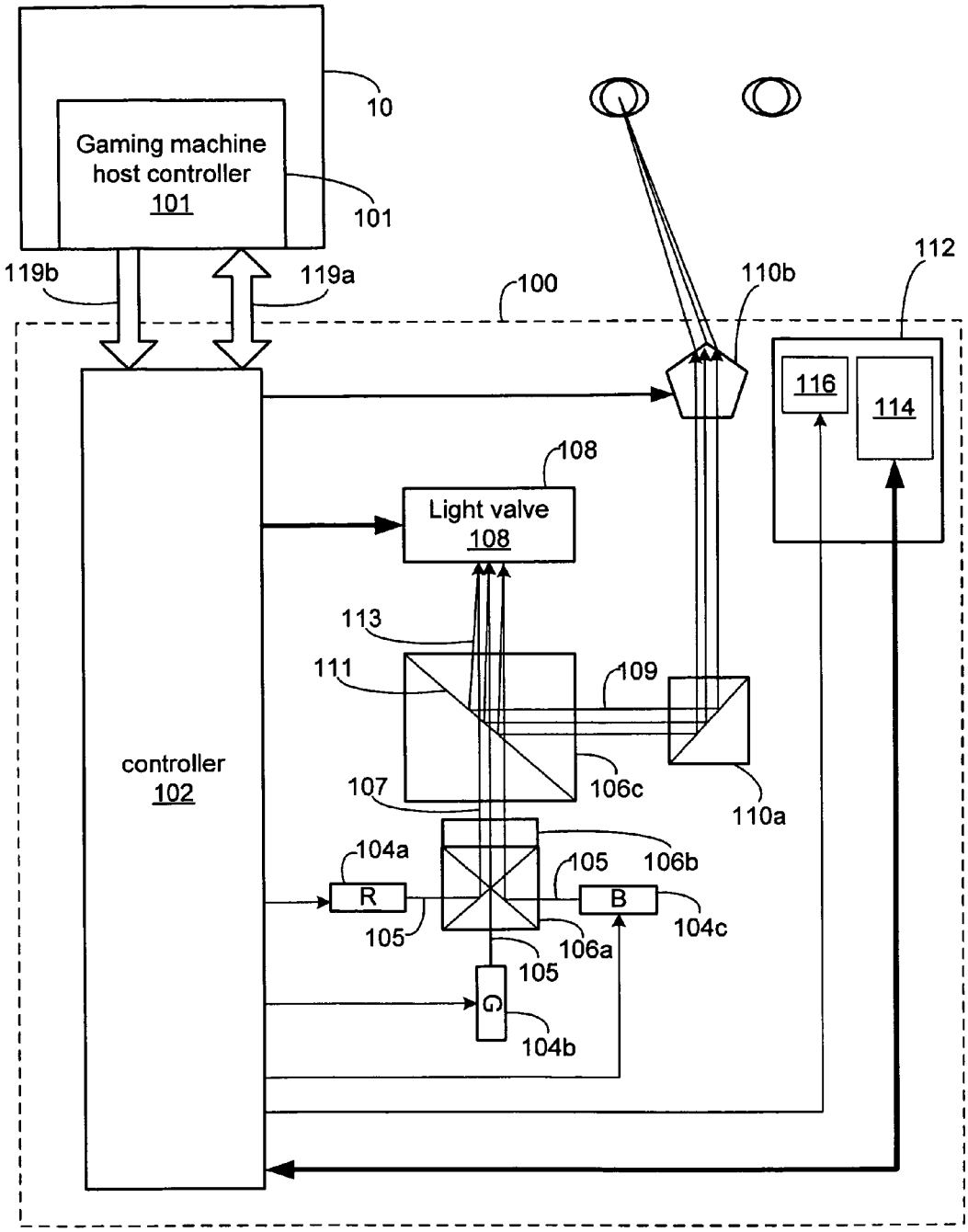
FIG. 2 illustrates a block diagram of a retinal image system in accordance with one embodiment of the present invention.

A retinal image system disposed in or about a gaming machine may take various forms. FIG. 2 illustrates a functional block diagram of a retinal image system 100 in accordance with one embodiment of the present invention. Functionally, retinal image system 100 includes three main components: a controller 102, an image casting system, and an eye tracking system 112.

Retinal image system controller 102 controls components within system 100 and issues control signals to each component in the system. Controller 102 also interfaces with gaming machine 10. Interface between controller 102 and a gaming machine host controller 101 may include one or more digital or analog communication links 119. One interface link 119*a* is used to communicate the control protocol between controller 102 and a host controller 101. Another interface link 119*b* provides a video stream from host controller 101 to retinal image system controller 102. The video stream includes image data for output to a player by retinal image system 100. The interface may alternatively include a single link. In a specific embodiment, the interface includes a single USB cable and USB communication protocols stored in both the gaming machine 10 and controller 12. Other hard wire and/or wireless communication systems and protocols may be used.

Information passed from the gaming machine host controller 101 to controller 102 may include video data for output by the retinal image system 100. The video data may be in a digital or analog format. In one embodiment, controller 102 receives data in a digital format and includes appropriate digital to analog conversion hardware and software for providing control signals to analog devices within system 100, such as motors and directing optics 110*b*.

The retinal image casting system generates an image in an eye of a player interacting with a gaming machine. The retinal image casting system includes light sources 104, transmission optics 106, light valve 108, and projection system 110.

Light sources 104 generate light. The light sources 104 may output one color or multiple colors. The number and type of colors provided by light sources 104 regulates the gamut of colors available to retinal image system 100. A monochromatic retinal image system 100 may include only one color light source 104. For example, light source 104 may only include one or multiple red diode lasers or red light emitting diodes. Alternatively, light source 104 may include three colors (red, green and blue) to provide a triangular gamut of colors under a CIE color mapping system, or another suitable color mapping system, that can be combined to produce an array of colors. In a specific embodiment, a red light source outputs light with wavelength of about 628 nm, a green light source outputs light with a wavelength of about 532 nm, and a blue light source outputs light with a wavelength of about 475 or 447 nm. Other wavelengths may be used for each color.

In one embodiment, light sources 104 include one or more lasers. As shown, light source 104 includes a red laser set 104*a*, blue laser set 104*b*, and green laser set 104*c*. Each color set may include any suitable number of lasers. The number of individual lasers will depend on the amount of light retinal image system 100 desires to produce, the light output of each light source, and the optical efficiency of retinal image system 100. In a specific embodiment, each laser is kept in the class IIIa range below about 1.0 mW. Other laser powers may be used.

In general, a laser refers to any device that relies on a lasing mechanism to generate light. Typically, a laser responds to electrical input and outputs photons and light. One advantage of lasers as a light source 104 is that they permit highly accurate temporal output, which facilitates control. Another advantage is that lasers produce highly directional and coherent light. Coherent light refers to light that is temporally and/or spatially in phase, which simplifies light path manipulation and transmission optics 106 that deliver light from light sources 104 to light valve 108. Laser light sources 104 may include diode lasers, diode pumped solid-state lasers, or any other suitable laser.

Diode lasers, or semiconductor lasers, refer to a class of lasers that rely on lasing action in a silicon-based lasing chamber. Many diode lasers employ opposing and parallel mirrors configured in a chamber carved into a silicon substrate. Electrical excitation of the silicon substrate generates light. One suitable red light generating silicon substrate includes GaAs. The opposing mirrors reflect light produced in the chamber, and one mirror includes a small opening from which light escapes the chamber. Since the mirrors are parallel, light emitted from the opening is generally output with a constant direction. The light is thus emitted with minor divergence at most, which can be corrected using an appropriate exit lens.

Light source 104 may also include a diode pumped solid-state laser. These lasers include a crystal that emits light when excited by a diode laser. The type of crystal will determine what color is emitted from the diode pumped solid-state laser. Diode lasers and diode pumped solid-state lasers suitable for use with the present invention are commercially available from a wide variety of vendors.

In another embodiment, light sources 104 include multiple light emitting diodes for each color. For example, light sources 104 may include blue light-emitting diodes, red light-emitting diodes and green light-emitting diodes. In this case, an output lens collects ambient light emitted by the LEDs and collimates the light for transmission along a desired optical path.

Transmission optics 106 are configured (e.g., positioned and dimensioned) to receive light from light sources 104 and transmit the light to the light valve 108. Transmission optics 106 may include any number of lenses and other optical components suitable for guiding and manipulating light along a desired optical path. As shown, transmission optics 106 for retinal image system 100 include a dichroic cube 106*a*, achromatic lens 106*b*, and a prism 106*c*.

Dichroic cube 106*a* receives light from each separate color light source and combines the three separate light paths 105 of each light source 104*a-c* into a common light path 107 for transmission onto the light valve 108 (via prism 106*c*). Dichroic cube 106*a* includes four faces; three faces each receive light from a different color light source 104, while the fourth face acts as an output for dichroic cube 106*a*. In one embodiment, dichroic cube 106*a* includes a pair of polarized reflectors (prisms). Each prism is designed to reflect a certain wavelength range. As shown, the red and blue light beams reflect towards the output face, while the green (wavelength between blue and red) light passes through towards the output face. Dichroic cubes suitable for use with the present invention are commercially available from a variety of vendors.

Achromatic lens 106*b* shapes light along a common light path 107 for transmission into prism 106*c*. For example, achromatic lens 106*b* may correct for any divergence or convergence in the light, and/or resize the light in flux area to suitably match the size of light valve 108. This is particularly useful when LEDs are used for light source 104; laser light sources 104 may not need an achromatic lens 106*b*.

Prism 106*c* a) permits light transmission onto the light valve 108 from light path 107, b) receives an image reflected from valve 108, and c) redirects the image out onto light path 109. Prism 106*c* includes a suitably angled surface 111 that selectively permits light transmission through it based on an angle of incident light. At certain angles, light reflects off surface 111; at other angles, light passes therethrough. As shown, prism 106*c* is positioned such that light from path 107 passes through surface 111 and onto light valve 108. In addition, prism 106*c* is positioned such that a reflected image 113 from light valve 108 reflects off surface 111 and along light path 109 to mirror 110*a*.

Light valve 108 selectively transmits light according to an input video signal. In the embodiment shown, light valve 108 includes a digital micromirror device. A digital micromirror device includes an array of tiny mirrors that are individually addressable and each actuated via a control signal issued by controller 102. Each mirror corresponds to a pixilated x-y position according to a resolution for digital micromirror device 108 and retinal image system 100. For the triple color path embodiment shown, light is sequentially output by each red, green and blue light source 104 and timed with controlled reflection by each mirror. Each mirror may be rapidly deflected so as to control the amount of light for each pixel and color. In an RGB color scheme where the video data for each color varies from 0 to 255, each mirror selectively reflects light for each color according to the video data. For example, a reddish color having RGB values of 240/15/25 at a given pixel is transmitted by a mirror for that pixel according to timed control signals provided by controller 102 that time with red, green and blue light transmitted onto the mirror for that pixel. Collectively, controller 102 similarly controls each mirror in micromirror device 108 to provide an output image according to the video data on a pixilated basis.

The number of tiny mirrors determines the resolution of light valve 108, which generally determines the resolution of retinal image system 100. Digital micromirror devices are commercially available with a wide array of resolutions. Texas instruments of Dallas Tex. provides a family of commercially available micromirror devices, such as the DLP series, suitable for use with the present invention.

In another embodiment, light valve 108 includes one or more transmissive-based light valves, such as three LCD filters that are each dedicated to selectively transmitting light of a specific color in a triple light path system. Such transmissive-based light valves are also widely commercially available, and use different light paths and optics than that shown for the reflective-based light valve shown. Image paths with transmissive-based light valves are known to one of skill in the art and the type of light valve 108 or particular light path employed does not limit the present invention.

The image 113 produced and reflected by light valve 108 travels back to prism 106*c*, reflects off surface 111 in prism 106*c*, and then proceeds along optical path 109. Retinal image system 100 then uses a projection system 110 that receives image 113 and transmits the image towards an eye of a player interacting with gaming machine 10.

Projection system 110 includes mirror 110*a* and directing optics 110*b*. Mirror 110*a* redirects the output image 113 from prism 106*c* to directing optics 110*b*. Focusing optics may also be included if light source 104 includes LEDs.

Directing optics 110*b* direct image 113 towards an eye of a person (which typically moves). To do so, retinal image system 100 needs to know the location of the eye being projected into. In one embodiment discussed below, system 100 employs a camera, an infrared system and logic based on an assumed interaction between the player and gaming machine to determine a current location of the player's eye. Directing optics 110*b* may include any suitable hardware to carry out its functions. For example, optics 110*b* may include one or more lenses coupled to positioning actuators, such as a one or more dc motors. Controller 102 then operates the actuators to steer the image into the person's eye using directing optics 110*b*. When light source 104 includes LEDs or produces non-coherent light, optics 110*b* may also focus an image at the player's eye.

In one embodiment, directing optics 110*b* raster scan an image towards the player's eye one pixel at a time. In this case, a positioning mirror included with optics 110*b* sequentially reflects and points video information one pixel at a time, in raster order, for an image. This leverages the eye's biological latency time for processing visual information by raster scanning pixilated data onto the retina so fast that the eye spatially perceives the fast moving and pixilated projection as a single image. Raster casting then repeats according to the refresh rate of the video data. This embodiment thus uses low power and high-speed image casting on a pixilated basis. In a specific embodiment, retinal image system 100 casts less than about 1 milliwatt of light. Other projection techniques and casting orders are suitable for use with the present invention. In another embodiment, the entire image is cast into an eye at once.

Retinal image system 100 may include optical configurations other than the specific example shown. For example, retinal image system may include one or more transmission type LCD light valves that employ three optical paths known to those of skill in the art. Transmission optics 106 may also include less or additional optics based on the configuration of retinal image system 100. For example, additional optics may be used to collimate light produced by LED light sources 104. Lasers output substantially coherent and collimated light, which reduces the complexity of transmission optics 106. However, light-emitting diodes may employ additional collimating optical components to increase optical efficiency. In addition, the retinal image system 100 shown in FIG. 2 includes one specific example of an optical path in transmission optics between the light source and light self one away. Other configurations are suitable in gaming machines of the present invention. In addition, a monochromatic system may include less complexity.

In order for the projection system 100 to project an image into a player's eye, system 100 needs the location of the eye.

Eye tracking system 112 detects and senses the position of an eye relative to a position of a gaming machine. In one embodiment, eye tracking system 112 outputs a signal indicative of the relative position between the person's eye and a gaming machine, or some specific component of the gaming machine such as projection optics 110. This information is used to provide control signals for the directing optics 110*b* and indicate where to cast the image.

People and their eyes move. Heads tilt and rotate, a seated player at a gaming machine shifts, eyes reposition to view different portions of a screen, etc. As the terms are used herein, eye location refers to locating an eye at a particular instance, while gaze tracking refers to locating the pupil and eye over time and accounts for movement by the eye. More specifically, eye location finds the eye relative to the head. Gaze tracking accommodates for where a player is looking with their eyes, which may be a combination of eye movement and head movement. Thus, the position and direction of the pupils, plus the rotation angle of the head, describe gaze detection information. Despite such movement, retinal image system 100 projects an image into the eye using repeated gaze tracking and detection of changing eye position. For example, eye tracking system 112 may produce a direction and spot position (x, y, z) at a desired refresh rate suitable for a raster scanning light beam output by the projection optics 110*b*.

In one embodiment, eye tracking system 112 includes a camera 114, eye illuminator 116, and a processing system configured to locate an eye relative to a portion of the gaming machine 10 and/or retinal image system 100.

Figure 3A:
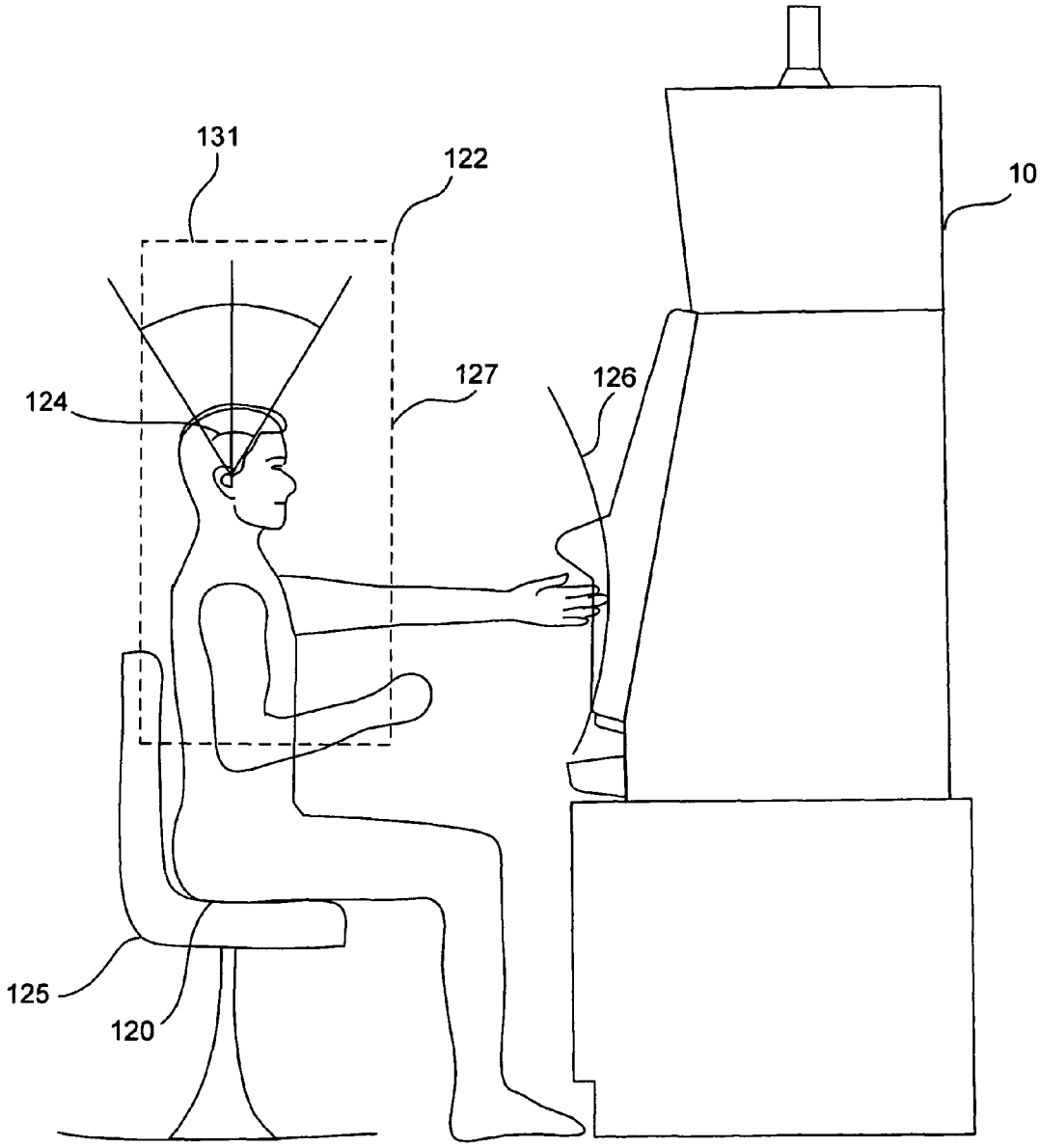
FIG. 3A illustrates a person seated in front of a gaming machine and a 3-D tracking zone in accordance with one embodiment of the present invention.

Camera 114 is configured to capture an image including an eye of a person when the person is near a gaming machine. FIG. 3A illustrates a person 120 seated in front of gaming machine 10. In this case, camera 114 (FIG. 1A, FIG. 4A, or FIG. 4B) includes a field of view such that a head of the player, while seated, is in the field of view and images provided by the camera include information related to the position of one or both of the person's eyes.

Camera 114 captures images of a viewing area around a gaming machine. In one embodiment, camera 114 is fixed and does not move relative to the gaming machine or area around the gaming machine. In another embodiment, camera 114 is positionable via one or more motors that allow the camera to move and the viewing area to change (e.g., to track a person moving in front or near the gaming machine). The camera may also employ automated optical and digital zooms to facilitate image capture. In some cases, finite location of a tracking zone (as will be discussed in more detail below) allows camera 114 to not need automated optical and digital zooms. The tracking zone also positions camera 114 on the gaming machine. For the gaming machine shown in FIG. 1A, the camera is fixed and positioned to capture an image of a person's head, provided that the person is sitting or standing in front of the gaming machine.

Thus, the present invention may leverage known interaction dynamics between a player and a gaming machine. For example, the player usually stands or sits in front of a video monitor during interaction with a gaming machine. Other assumptions may be used top facilitate eye location and tracking. A retinal image system may be configured with one or more of these assumptions to scan a finite area or space where the player and their eyes are expected to be while interacting with a gaming machine.

In one embodiment, the present invention defines a tracking zone 122 to facilitate detection of a person and/or their eyes. The tracking zone 122 refers to an expected region in which an eye, or another portion of the person such as the head, is expected to be located when the player interacts with a gaming machine. In one embodiment, the tracking zone 122 is determined during design of system 100 and defines a finite area where the player's head or eyes should be located when playing a game. This logically confines the area and space for detection and image casting, and provides a responsive eye detection system that is able to detect and track eye location and stare vergence (where the eye points) in real time.

Tracking zone 122 may be two-dimensional (a plane) or three-dimensional (a box). A 2-D tracking zone 122 may include a predetermined rectangle in a camera image. Width and height may be suitable to quantitatively characterize a 2-D tracking zone 122. A 3-D tracking zone 122 may include a predetermined rectangle plus a depth that collectively provide a 3-D box for zone 122. Other shapes may be employed, and a variety of coordinate systems may be used to spatially characterize tracking zone 122. A 2-D tracking zone 122 (or a plane included in a 3-D zone) is useful to set a field of view for camera 114.

Tracking zone 122 may be sized according to an application. In one embodiment, the tracking zone is sized according to the size of a person's head interacting with a gaming machine. In a specific embodiment, the tracking zone estimates a likely position of the player's head or eyes while sitting and/or standing in front of the gaming machine.

As mentioned above, the present invention may leverage known interaction dynamics between a player and a gaming machine. One or more assumptions may be used to help determine the size of tracking zone 122. One assumption is that a person usually stands or sits in front of a video monitor during game play.

Another assumption is that, when game play begins, the player would have just pressed a button on the gaming machine or touched an icon on a touch video monitor. This means that the player would be at most arms length (14" to 20") away from a known location (button, touch screen, etc.) on the machine.

This physical contact proximity assumption also permits probability estimates on height of people in front of the gaming machine. Standard ergonomic charts provide relative positions between a player's eyes and a chair that they are seated on, whose position is known. More specifically, known setup information and ergonomic seated height charts provide a range as to where the person's head should be. Since chair height is know relative to the gaming machine from gaming machine design and construction, say a typical gaming stool or seat positioned in front of a gaming machine, then a range of heights where the eye (or head) should be can be determined from the ergonomic charts. This provides a height range—or vertical dimension—for tracking zone 122.

One specific ergonomic chart pertinent to the design of workstations provides for a range of people sizes and positions between a chair and a person's eyes. Tracking zone 122 based on information from the ergonomic charts may be selected by a percentile capture, which estimates a percentage of people within the tracking zone, e.g., 50%, 95%, 98%, etc. In other words, the larger tracking zone 122, the more people that camera configured based on tracking zone expects to see. One or more ergonomic rules of thumb may be applied when designing tracking zone 122. 'Sitting height' refers to a distance from a person's seat to the top of their head; 'eye height in a sitting position' refers to a distance from a person's seat to their eyes. For example, the height eye height of males in a sitting position is about 13 centimeters (between the top of their head and their eyes) less than their sitting height; that of females is about 10-12 inches less. Similarly, when people sit normally (with some slump), their eye height lowers (between the seat and their eyes) by about 3 cm for males and the same for females. Other ergonomic rules may be used in designing tracking zone 122.

A buffer may also be added to the tracking zone 122 height to capture more people. The buffer may be a percentage of the height, such as 10% on the top and bottom, or a set number such as 10 centimeters on the top and bottom. Other buffers factors may be used.

In one embodiment, the ergonomic seated height charts and buffer factors provide tracking zone 122 bottom edge and top edge, respectively, about 24" and about 36" above the seat height, which should capture the majority of adults that play at a gaming machine. This provides a tracking zone height 127 (FIG. 3A) of about 12 inches (36−24=12). Other bottom edge and top edge distances for tracking zone 122 may be used. In one embodiment, tracking zone 122 includes a height 127 from about 4 inches to about 24 inches. In a specific embodiment, tracking zone 122 includes a height from about 8 inches to about 16 inches. A second camera can be used to increase height 127 and other tracking zone 122 dimensions.

Figure 3B:
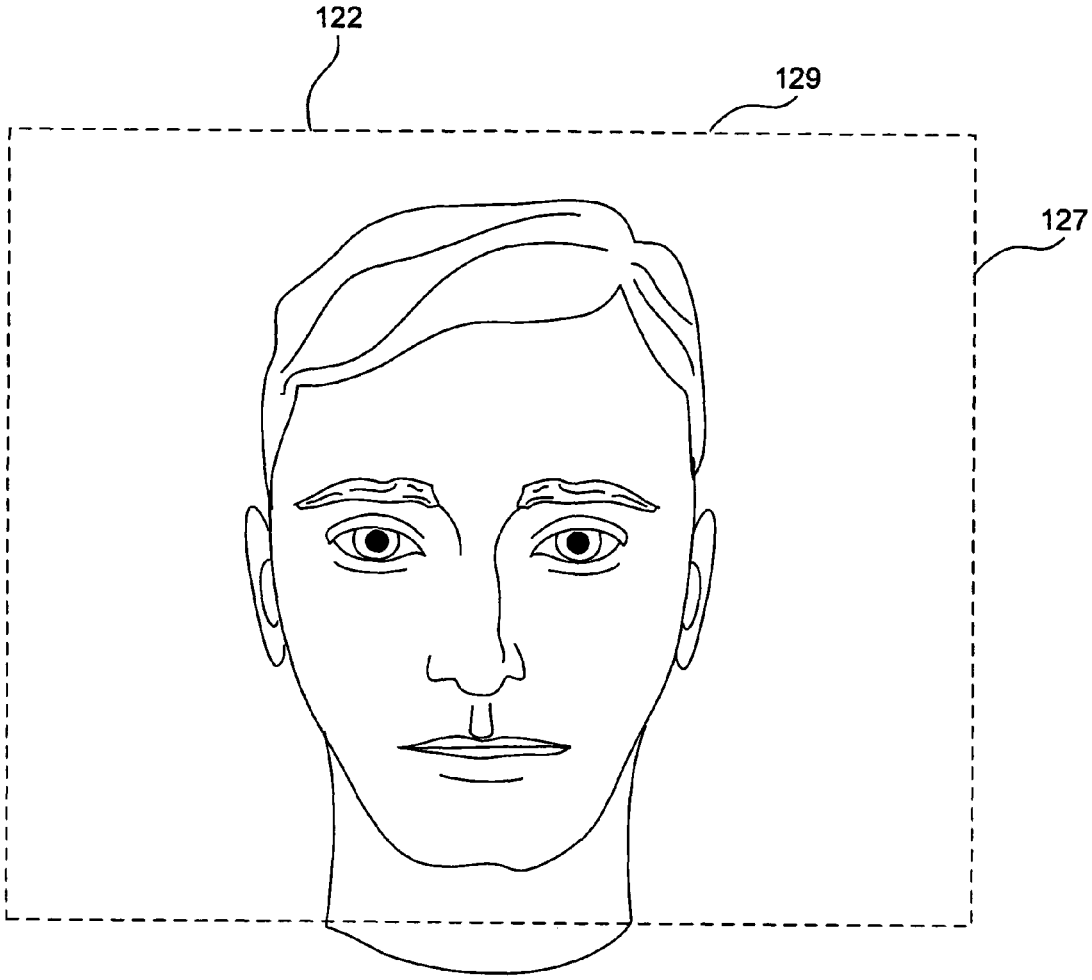
FIG. 3B illustrates a 2-D tracking zone in accordance with another embodiment of the present invention.

Ergonomic estimates may also be used to build a width 129 for tracking zone 122 (FIG. 3B). Available ergonomic charts for interpupillary breadth provide statistically common distances between two eyes. These charts are used in the design of eyeglasses, binoculars and other optical aids, for example. A distance between eyes from about 1.25" to about 3.0" covers the majority of people. A logical 3.0" max between two eyes allows the detection of one set of eyes from multiple sets within tracking zone 122. During processing of the video information, this logically filters out a second person in tracking zone 122 who also is looking at the screen to view an image the first person sees.

A buffer may also be added to width 129 for tracking zone 122 to allow for horizontal head movement to each side (left & right) and head rotations about a vertical axis. A horizontal buffer ranging from about 3 inches to about 10 inches added to each side is suitable for many gaming machines. In a specific embodiment, the horizontal buffer is about 6 inches. Other horizontal buffers may be used to allow for eye detection.

Cumulatively for width 129, tracking zone 122 may range from about 7 inches to about 23 inches. A 15 inch width 129 is suitable in many instances. Other tracking zone widths width 129 may be used.

A depth 131 or depth range may also be predetermined for a 3-D tracking zone 122 (FIG. 3A). As mentioned above, a player is typically within arm's reach when interacting with a gaming machine. Using a range for ergonomic arm's length variability from 14" to 20", and adding 6" for head movement back and forth, provides a 12" depth to tracking zone 122. Other depths may be used. In a specific embodiment, the tracking zone 122 is a 3-D cube with 12"×12"×12" dimensions.

Position for tracking zone 122 relative to a gaming machine may also be pre-determined in 2-D or 3-D space. The position may be determined relative to any point on the gaming machine, such as the projection optics 110*b* or camera 114. In one embodiment, the horizontal center of the gaming machine is used as the horizontal center of tracking zone 122. The average eye height of a sitting person (known from ergonomic charts) for the chair (whose height is also known) in front of a gaming machine may be used as the vertical center of tracking zone 122. Depth may be determined using ergonomic arm's length variability from the front face of the gaming machine, or certain buttons and features that the person touches. In a specific embodiment, the vertical center of tracking zone 122 for a person sitting on a 26" gaming chair in front of video gaming machine is: 56" (height), in the horizontal middle of a 30" wide machine (width), and has a center depth of 17" ((20−14)/2+14). In this case, the player should be looking at the front face of the gaming machine, e.g., if the player just won a jackpot or received the entry to a bonus game or level. Other centers and ergonomic assumptions may be used.

As the size of tracking zone 122 and field of view for the camera increases, image detail of video information available to processing images produced by the camera decreases for a fixed resolution camera. The tracking zone thus presents a trade-off: visual information detail in each image versus size of the tracking zone. In one embodiment, tracking zone 122 is reduced in size to increase the detail of visual information in images captured by camera 114.

Since people vary significantly in height, the tracking zone may be set to capture a statistical subset of all possible heights. For example, the tracking zone may be set in its vertical dimension to capture 95% of the heights available for people standing and/or sitting in front of the gaming machine. Other statistical ranges may be used.

Tracking zone 122 may also be altered in size to compensate for expected movements of a player interacting with the gaming machine. As illustrated in FIG. 3A, an angle 124 characterizes easy head tilts of a seated person that result in changes in the vertical position of a person's eyes. Tracking zone 122 may thus be tailored in size to accommodate for changes in location of a person's eyes due to changes in angle 124. Other ergonomic considerations may also be used in defining tracking zone 122.

While FIG. 3A illustrates a person seated in front of a gaming machine, and uses this assumption to build tracking zone 122 and locate an eye, the present invention is not restricted to any particular position of a person relative to a gaming machine. For example, tracking zone 122 may be configured to locate an eye of a person standing near a gaming machine and direct an image into the standing person's eye. Or configured for both standing and sitting. In one embodiment, present invention casts an image into an eye of the person as long as the person is within about 1 meter to about 3 meters of the gaming machine.

Referring back to FIG. 2, eye illuminator 116 is located within or about the external cabinet of gaming machine 10 and is configured to illuminate the person's eyes so as to improve detection of an eye. Illuminator 116 directs light towards the person while the person interacts with the gaming machine.

In one embodiment, the present invention uses eye reflection to help track the position of an eye. In one embodiment, illuminator 116 uses reflection of light from a person's eyes. Red-eye reflection is a common phenomenon in photography. The red color comes from light that reflects from a person's eyes and typically occurs in photography when a flash is used. The flash is bright enough to cause a reflection off of the retina; what is seen is the red color from blood vessels nourishing internal portions of the eye. Illuminator 116 may similarly provide light so as to produce a reaction in the eye that is detectable by camera 114. The reaction is visible, captured in an image, and produces information in the resulting image that is used for eye locating.

In one embodiment, eye illuminator 116 emits infrared light. When an eye is illuminated with infrared light, the retina reflects light and becomes more detectable in an image captured by a camera. In a specific embodiment, eye illuminator 116 includes an infrared light source, such as one or more infrared light-emitting diodes. In this infrared embodiment, camera 114 includes an image device (CCD, etc) that is able to detect the normal color wavelengths as well as a range of infrared (IR) wavelengths. In other words, the IR light source falls within the receiving spectrum of camera 114. Many suitable camera CCDs offer a wide receiving spectrum that allows the IR reflection to show up in the image as a lighter or brighter spot. The camera is still receiving a color image so some of the colors may shift to red or white. In another embodiment, camera 114 is an infrared camera. Some infrared cameras use a charge-coupled device that converts incoming light to grayscale information. Each of the grayscale pixels will detect and convert incoming light to a digital format, such as a 256 gray scale light intensity.

Figure 4A:
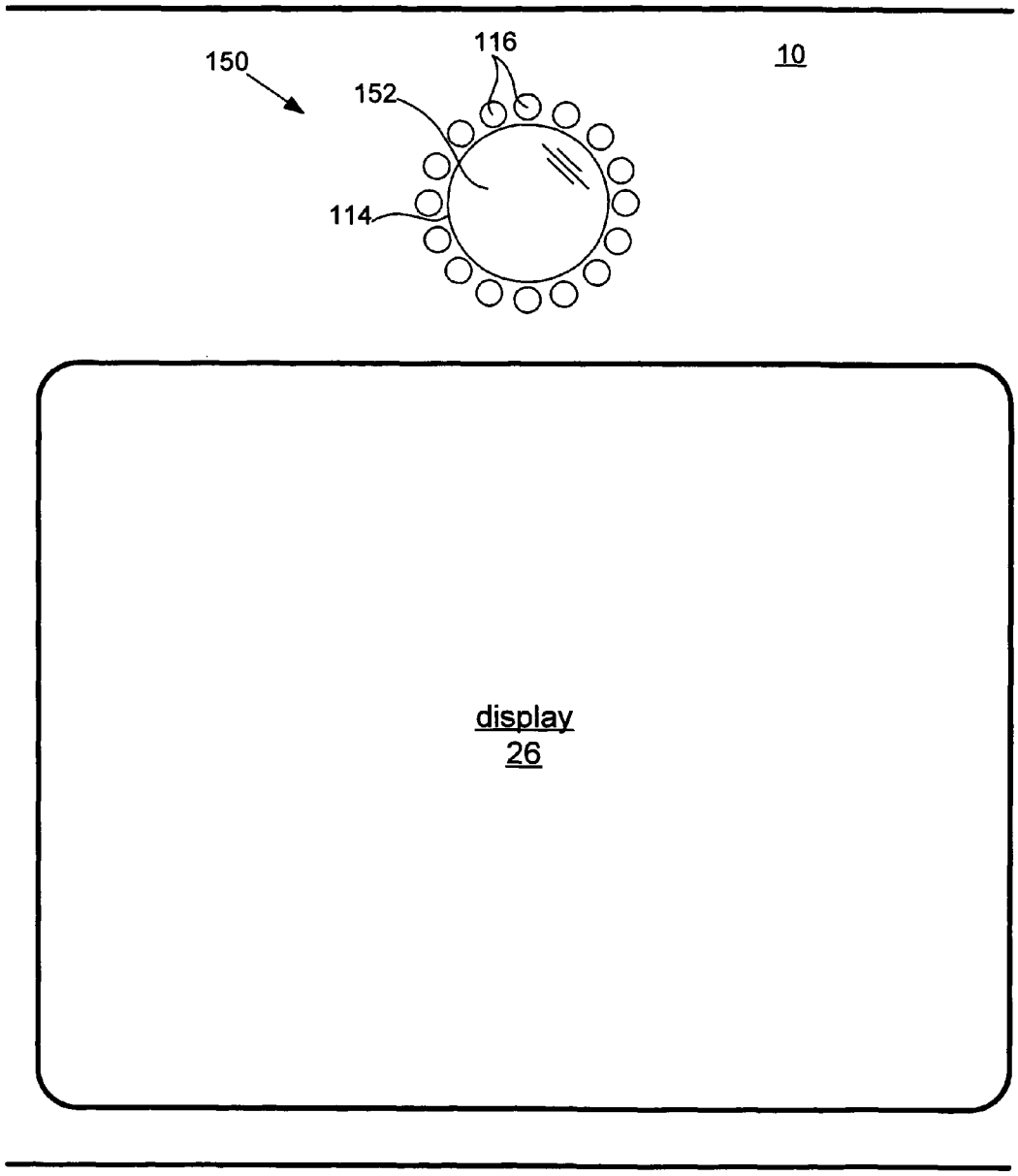
FIG. 4A illustrates one suitable arrangement for a camera and an array of infrared light-emitting diodes used in locating the eyes of a person interacting with a gaming machine in accordance with a specific embodiment of the present invention.

One way to reduce "red eye" in photography is to move the flash away from the lens. The present invention, however, may do the opposite. In one embodiment, camera 114 and infrared light sources 116 are disposed close to each other such that infrared reflection from an eye is increased for detection by camera 114. In addition, illuminator 116 may be located close to display 26. FIG. 4A illustrates one suitable arrangement 150 for camera 114 and a circular array of infrared light-emitting diodes 116 that are both located close to display 26. In this case, infrared LEDs 116 are disposed circumferentially about a lens 152 of camera 114. In addition, camera 114 is located at the middle of the top edge of display 26. Other proximate configurations between camera 114, an infrared light source 116, and display 26 may be used. For example, the infrared light source 116 may include a single IR LED arranged next to camera 114.

In another embodiment, numeral 152 refers to a protective window behind which both a camera and the projection system are located. Co-locating the camera and projection system may reduce positioning differences and errors.

A variety of commercially available cameras may be used for camera 114. In a specific embodiment, camera 114 is a model number #EC-PC-CAM as provided by Elyssa Corp of Briarcliff Manor, N.Y. This color camera changes to black and white when light levels drop, and relies on a filter to improve IR sensitivity. A suitable black and white camera with near infrared capability is model number #20K14XUSB as provided by Videologic Imaging of San Diego, Calif. Other cameras may be used.

Figure 4B:
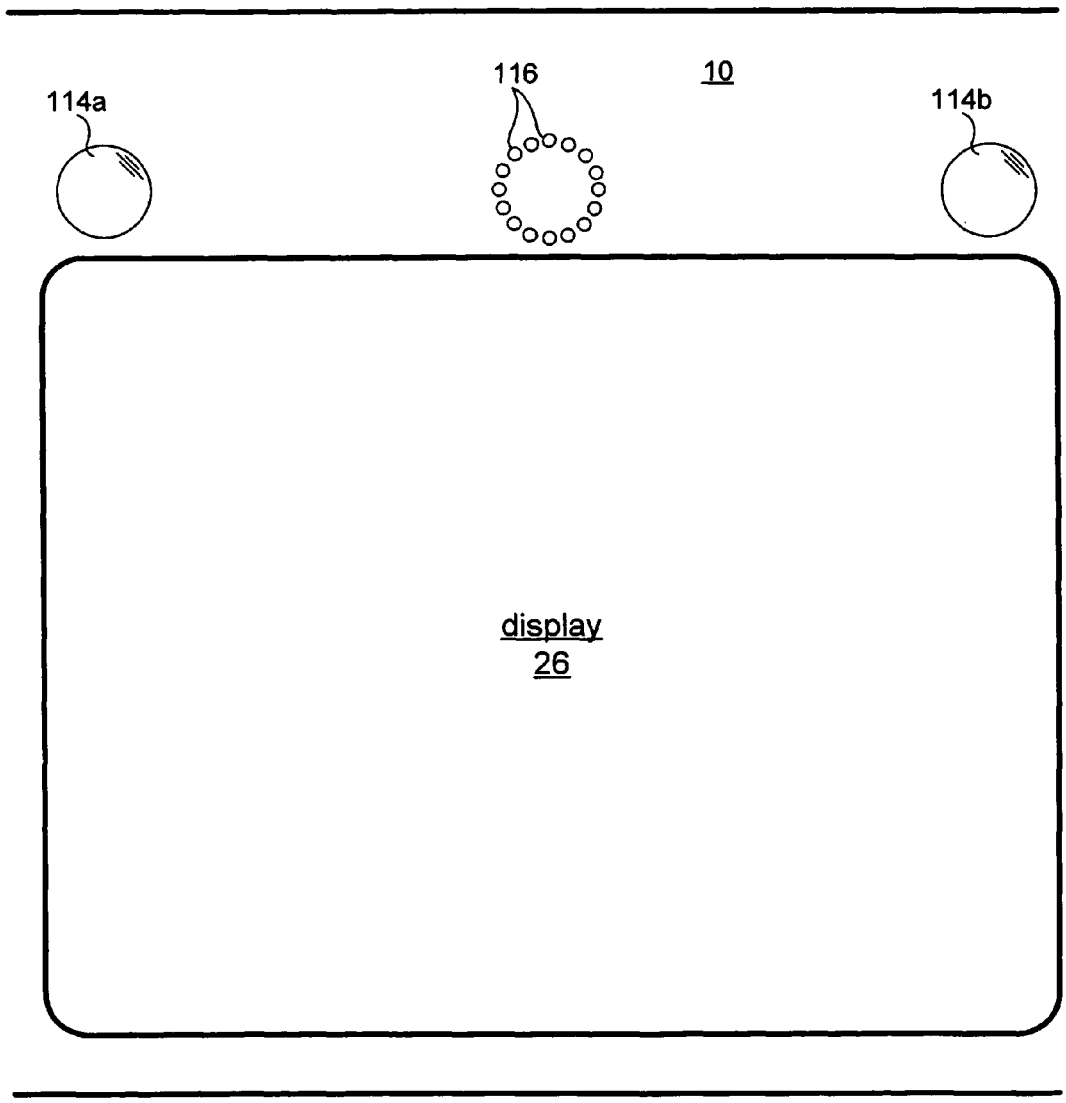
FIG. 4B shows multiple cameras used in locating the eyes of a person interacting with a gaming machine in accordance with another specific embodiment of the present invention.

Multiple cameras 114 may be used. For example, multiple cameras are helpful when the eye tracking system employs a large tracking zone 122. A single camera can typically track head rotation up to –/+30 degrees; multiple cameras increase the permissible viewing angle. FIG. 4B shows a two-camera system in accordance with a specific embodiment of the present invention. Each camera 114*a* and 114*b* is located near a top corner of display area 26 and the IR light source is located in the center. Two cameras 114 increases the permissible size of tracking zone 122. It also improves tracking the rotation of the person's head and eyes to larger angles away from the display 26.

Figure 5:
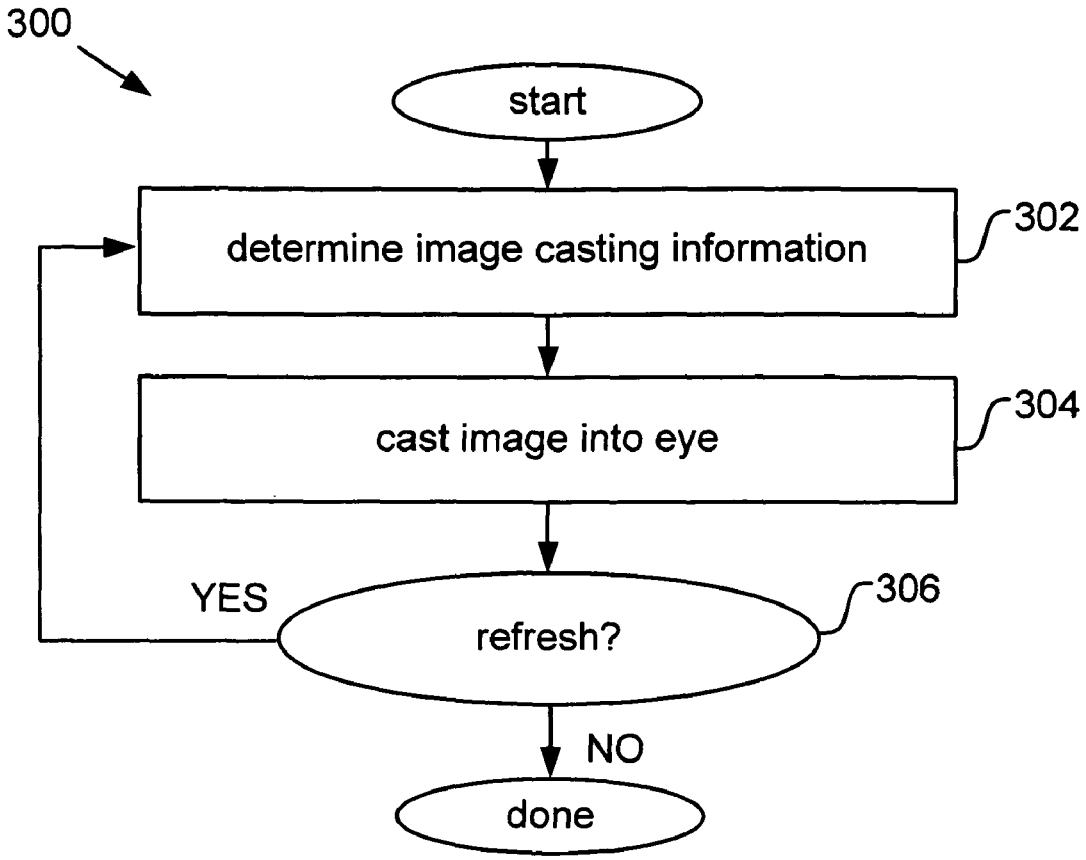
FIG. 5 illustrates a process flow for providing retinal images to a player of a gaming machine in accordance with one embodiment of the present invention.

FIG. 5 illustrates a process flow 300 for providing retinal images to a player of a gaming machine in accordance with one embodiment of the present invention.

Process flow 300 begins by determining image casting information used to cast an image into the eye of a player interacting with a gaming machine (302). The image casting information refers to the spatial position of a person's eye relative to the gaming machine, or some component thereof. For example, the image casting information may include the location of the eye in a tracking zone (described below) or within a known and steady field-of-view of a camera. Retinal image system 100 relies on knowing the location of the person's eye relative to the gaming machine or projection system. Since the camera and projection system (and most other components on the gaming machine) are fixed, knowing position of the eye relative to one of these components allows the position of the eye relative to the projection system for image casting into the eye from the projection system. As mentioned before, people vary in size, which affects variability in where an image is cast. A tracking zone as described above accounts for such variability.

In addition, people and their eyes tend not to remain still. This dynamic behavior forces the retinal image system to track eye position and responsively change the direction of image projection (see FIG. 6).

Figure 7:
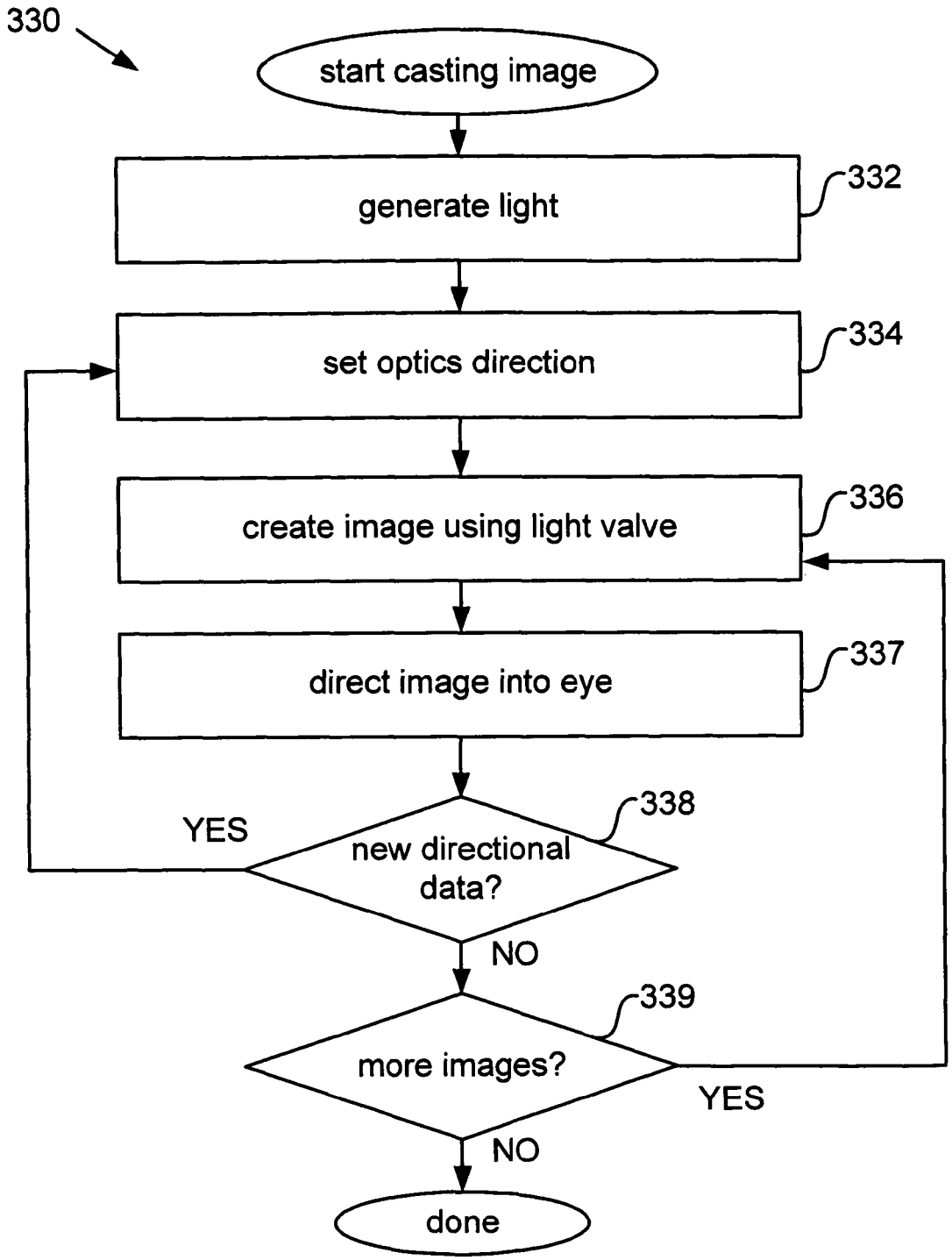
FIG. 7 illustrates a process flow for casting an image into an eye in accordance with one embodiment of the present invention.

Once the image casting information has been determined, retinal image system 100 then projects an image into a person's eye (304 and FIG. 7). In one embodiment, the image is substantially two-dimensional, as perceived by the person. In another embodiment, the image is perceived as being three-dimensional.

Process flow 300 may continuously repeat according to a predetermined refresh rate (306). The refresh rate may include i) a refresh rate of video information provided to the person, or ii) a tracking rate for locating a player's eye. Typically, the refresh rate for process flow 300 is the greater of these two rates. The rate of video alteration may be similar to other forms of video output, such as flat-panel display technologies. For example, video images may be refreshed at a rate of 16, 24 or 32 images per second. Other video image refresh rates may be used with process flow 300.

The tracking rate detects movement of an eye and/or person at a predetermined rate. This maintains a retinal image in an eye despite movement of an eye or person. It is understood that retinal image system 100 may output static video data that does not vary over time, but still implement a tracking refresh rate that compensates for eye movement. Process flow 300 may thus repeat even though the video image cast into the person's eye includes unchanging video information.

The exact refresh rate used may be stored in software, and may change. A retinal image system may increase the refresh rate when a player plays a game to improve tracking and image perception quality, for example.

In one embodiment, each refresh captures a new image of a person positioned near a gaming machine. Each image may then be analyzed for: 1) facial outline, 2) eye region, 3) eye position, 4) iris size and geometry, 5) iris to pupil centers, and 6) pupil to pupil center.

Figure 6:
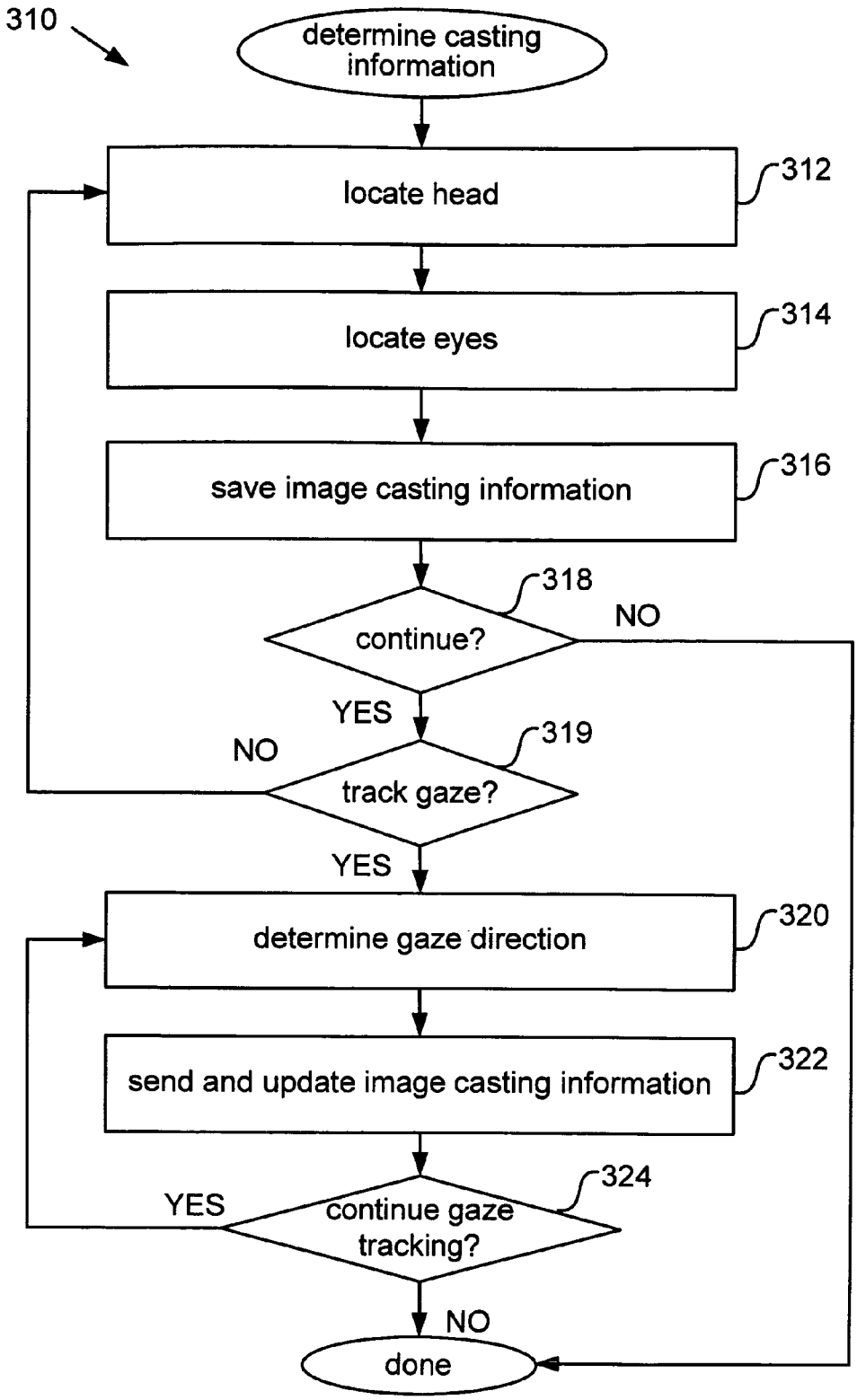
FIG. 6 illustrates a process flow for determining image casting information used to cast images into the eye of a person in accordance with one embodiment of the present invention.

FIG. 6 illustrates a process flow 310 for determining image casting information in accordance with one embodiment of the present invention (step 302 of process flow 300). Process flow 310 uses a combination of video detection and computer processing of the captured video information to determine the image-casting information. In addition, process flow 310 both locates an eye, and if necessary, performs gaze tracking over time that accomodates movement by the eye and person.

Process flow 310 may begin with detection of a person near a gaming machine. A player often provides definite input when interaction with a gaming machine begins. For example, starting play for a game may include depositing credit, selecting one or more buttons such as deal/draw for a poker game, initiating a spin on a slot game, or other start indicia for other games. In another embodiment, a camera continually captures images of a tracking zone in front of the gaming machine. Motion detection between consecutive images captured by the camera may then be used to detect entrance of a person into the tracking zone. Many motion detection algorithms are suitable for such person recognition. At some point, detection of a person near the gaming machine triggers a host controller included in the gaming machine to send a command to initiate the retinal image system 100. In one embodiment, the controller communicates with a retinal image system controller to begin eye location and tracking.

Eye location may begin by locating a person's head (312). In one embodiment, head location applies visual processing techniques to an image captured by a camera to produce head and/or face edge features. More specifically, video information in an image captured by the camera is processed to locate edges of the player's head using one or more visual processing techniques. These techniques may include edge detection algorithms, smoothing operations, etc. One of skill in the art is aware of the various visual processing, biometric and face recognition computer-implemented techniques that may be used to locate a head within an image. One suitable method for detecting the presence of a person relative to a gaming machine is described in commonly owned U.S. Pat. No. 6,645,078, which is incorporated by reference herein in its entirety for all purposes. Additional visual processing techniques are well known to one of skill in the art and the present invention is not limited to any particular visual processing technique for locating a person or head in a video image. Step 312 produces an edge outline of the player's head and/or face. It may also produce facial edge information for one or more facial features, as will be described below.

Process flow 310 may also determine a distance between a person's head and the gaming machine or image casting optics. This is useful when the light source does not include a laser and requires focusing based on the casting distance. In a specific embodiment, step 312 also overlays a model head or face to the edge outline produced from the edge detection. The model represents a generic head or face having spatial dimensions at a predetermined distance. A person at a shorter distance to the camera will appear larger in an image than a distant person; the difference relates to the person's distance from the camera. The model head size may be arbitrarily set according to a predetermined distance. Difference in size between the edge outline and the model then permits determination of a distance from the person's head to the gaming machine, or some reference on the gaming machine.

One embodiment uses a tracking zone that determines field of view for the camera (and what information the camera captures for edge detection). The tracking zone also determines distance for sizing the model head or face. The depth center for the tracking zone may be used as the predetermined distance, e.g., the distance from the gaming machine to the 3-D box center, measured along the floor. As mentioned above, once a player begins playing a game at the gaming machine, it may be assumed that the player is standing or sitting in front of the gaming machine—and within arm's reach. This provides a starting position for electronic sensing of the person's head and features using a camera, and provides a high probability estimate of proximity between the person's head and the gaming machine.

Once the head has been located, the processing system then locates one or both eyes for the person (314). One or more methods may be used for eye detection. For example, infrared red-eye techniques or edge detection of video information in an image produced by camera 114 are suitable.

In one eye location technique, the processing system analyzes video information in an image, or a portion thereof around the eyes, produced by camera 114 to determine the location of the eyes. The edge detection performed for head location may also be configured to locate the player's eyes in the image. Any suitable computer-implemented visual processing, biometric, and face recognition technique may be used to locate one or more eyes in an image. For example, an edge detection algorithm and face recognition logic may be combined to identify and locate the face of the person, eyes within the face, and pupils within the eyes.

In another embodiment, infrared red-eye techniques are used to locate and improve eye and pupil location detection. These may be useful, for example, if only a portion of a face is visible due to obstruction and/or the overlay doesn't fit. In this case, the retinal image system controller turns on the IR light source and the camera captures reflection of this light. An infrared image produced by the camera includes significantly improved data for the person's eyes, facilitates edge detection of the eyes and pupils by increasing contrast between the reflective eyes and non-reflective parts of an image, and provides greater salience of video information used to identify the location of one or both eyes.

Multiple methods may be used to locate the eyes. Multiple methods are useful to verify the results of one method with another and increase confidence of eye location. In a specific embodiment, process flow 310 first uses edge detection to locate the eyes and then verifies location of the eyes using IR scanning and video processing. In this case, the infrared red-eye techniques verify and improve eye and pupil detection. The IR light source can turned on/off to switch between to normal camera mode and IR detection. If results of the multiple methods do not match, or fit within some predetermined agreement range, then process flow may repeat one or both eye detection methods. When completed, step 314 provides one component of image casting information: the location of an eye. Process flow 310 saves the image casting information (316).

Process flow 310 may also determine other casting information. The nature of laser light does not require focusing and does not substantially vary with range from the projection optics to the player. However, not all light sources that can be used in a projection system are range independent. When the optical projection system uses a light source or projection configuration that needs focusing, such as some LED systems, and relies on knowledge of range to the person, then process flow 310 may also determine range to the person. In a specific embodiment, range determination uses a measure of the distance between a person's eyes. This determination uses locations of each eye previously determined from an image; and calculates a distance between features or other common reference points for each eye. One reference point may be the inside edge of each pupil. Another reference point may be the center of each pupil. Other eye features and reference points may be used.

As mentioned above, the distance between a person's eyes and the projection system is useful in some instances, e.g., when the light source does not include lasers. The distance between eyes may also be converted into a distance from the person's eyes to the projection optics included in the retinal image system. Thus, the processing system a) calculates a distance between eyes previously determined from an image, b) assumes a relatively constant distance between eyes for all people, and c) scales the measured distance between eyes to determine an orthogonal distance from the person to the camera. This last step compares a ratio or template of the measured distance between eyes against the statistically common distance between eyes for most people. This ratio or template then provides the range between the person's eyes and the camera. This information may also be saved. To avoid range determination, an LED light source can be focused to the expected center of the head while allowing for the 6" difference from front to back without needing any refocusing.

A check is made to continue eye location detection (318). Stoppage is desirable when interaction has stopped, the game is over and no additional credit has been provided, the person has left the machine according to motion detection, etc. If the person leaves, then process flow 310 is done and waits for another person. If the person remains, then a check for gaze tracking occurs (319).

Gaze tracking begins when an image is to be cast into the person's eyes. This is a matter of game, casino, and gaming machine design. Suitable projection scenarios include when a bonus event occurs on a gaming machine. In this case, the retinal image system projects images during a bonus and includes video information related to the bonus. A win or win mode on a game may also trigger the retinal image system projection and gaze tracking. During this game mode change, the gaming machine's controller may send a command to "track".

Gaze tracking determines a gaze direction of the person (320). Gaze direction determination accounts for two degrees of freedom: the first relates to the person's face direction and orientation, while the second relates to location of the pupils on the face.

For face direction and orientation, head position and rotation will affect eye position, and may change. In other words, indirect angles between the person's face and camera will affect eye position and image casting direction. This includes both head tilts (up and down) and rotations (left to right). A camera catches the changes and video information provided by the camera is processed to look for indicators of tilts and rotations, such as changing distances between edges of the face and/or color or shading changes. As mentioned above, multiple cameras may be used to increase the range of detectable indirect angles between the person's face and a camera. However, typical interaction between a person and a gaming machine includes the person facing a video screen and, after significant gameplay, squarely looking at the video screen with little angle of their face away from the plane of the monitor. The present invention may use knowledge of this interaction and install a camera relatively close to the lateral center of a video screen on a gaming machine. Regardless, head position and rotation are monitored during gaze tracking so the eye position can be tracked in real time in the event of off-center head movements.

Pupil location may change as the person looks at different parts of a screen. Video output then, which is known, may act as a first approximation of where the eyes are pointing. For example, a winning sequence on the main display area will include animated images and/or lights flashing and/or audio. This aids in gaze tracking since the player shifts his or her attention to a known area in the display area.

Edge detection of video information, including and near the eyes, in an image captured by a camera will also provide pupil location (this information was gained in 314). More specifically, knowing location of the eyes, the eye area is extracted from an image by a virtual display controller. Pupil location is then detected (via edge detection and/or other suitable visual processing techniques) and tracked. This can be refreshed as desired. IR and other techniques can also be used to assist or verify pupil identification and location within the eye. The amount of reflection can be measured. Higher reflection indicates the pupils are in a relative direct line to a light source.

Gaze tracking accommodates for the two degrees of freedom. Thus, changes in the distance between edges of the face, plus color or shading changes, detects any head rotation or tilt. These changes are extrapolated to provide correctional pupil location data. In one embodiment, a gaze tracking algorithm combines the two degrees of freedom. If the system senses a 5 degrees head rotation, then eye location rotates 5 degrees. If the player maintains constant gaze at a certain spot in the display area, then the pupils have shifted the opposite directed to the head rotation.

In a specific embodiment, momentary eye movements (less than about 100 ms) are ignored. These may include and accommodate for blinking and other types of involuntary eye movements.

The present invention provides robust gaze tracking. People with glasses can be serviced. In some cases, heavy dark glasses and extremely blood shot eyes can affect detection, and process flow 310 may stop projection for these people or use alternate techniques. For example, pupil location can be solely estimated using head position. If the system cannot suitably estimate image casting information, then the virtual display controller may request the game controller to provide feedback to a player. This may include a flashing message, which causes the player to look at a specific and known portion of the screen.

When completed, step 320 provides another component of image casting information: the location of a pupil relative to the eye. Process flow 310 saves this image casting information and sends it to the image casting controller (322). The image casting controller then sends appropriate control signals to the projecting optics based on the eye and pupil locations.

A determination is made to continue gaze tracking (324). This may occur at a desired refresh rate or upon other conditions, such as whether the bonus mode, winning outcome, or other visual information being presented, has finished.

Once the gaze tracking is working, the virtual display controller starts projection. Typically, there will be minimum pupil movement when a player sees the projected image, but the gaze tracking system can tolerate significant pupil and head movement during casting. In one embodiment, the image casting system tolerates up to 15 degrees of head rotation and/or tilt and lateral head movement within the tracking zone.

Since the relative position between camera 114 and projection optics **110*b* are known from manufacture and assembly of the gaming machine, the distance between one of the person's eyes to the projection lens of the retinal image system is easily obtained by simple addition or subtraction of the difference in location between the projection lens and receiving camera on the gaming machine. Either eye for the person may be precisely and dynamically located in this manner relative to the projection lens. This changes any information produce by processing video information in the camera to location of the projection optics. Image casting may proceed into either eye using retinal image system 100**.

Once the processing system determines the location of each pupil or eye relative to the projection optics of the retinal image system (the casting direction), an image is then cast into an eye. FIG. 7 illustrates a process flow 330 for casting information into an eye in accordance with one embodiment of the present invention (step 304 of flow 300). One suitable system for implementing process flow 320 was described above with respect to retinal image system 100 of FIG. 2.

Process flow 320 begins by generating light (332). In one embodiment, the retinal image system includes lasers and light production relies on a lasing mechanism. Light generation may also include production by light emitting diodes, a halogen lamp, or other light production device is suitable for use in an optical projection system.

The image casting information is then used to set directions for the projection optics components (334), which occurs slightly before creating the image using the light valve due to the speed of light. The projection optics are then ready to redirect light from the transmission optics in the projection system outside the gaming machine to an eye.

Transmission optics then transmit the light from the light source to a light valve. The transmission optics may perform one or more of the following optical functions: a) direct light generated by the source along one or more light paths; b) collimate the light (if not already collimated) such that it travels within desired ranges of convergence and divergence along a light path; c) change flux size as desired; d) even or smooth flux intensity distribution; e) combine multiple light paths into a single common light path (e.g., combine three light paths for three separate colors into a single common light path onto the light valve); and f) position the light path for transmission onto the light valve.

The light valve then receives the light and creates an image based on video information provided to the light valve (336). A video signal carries the video information, on a pixilated basis, and is typically converted to light information in real time. One suitable light valve reflects incoming light on a pixilated basis to produce a reflective image. Another suitable type of light valve selectively allows light to pass through plane on a pixilated basis to produce a transmissive image. The present invention is not limited to these two specific types of light valve technology or any other particular light valve technology. Additional transmission optics transmit the image from the light valve to a projection system for the retinal image system.

The projection system casts an image into the player's eye (337) using the directional position set in 334. The image may be 2-D or part of a 3-D image construction. One or more motors (or other suitable actuators) control the position of a projection lens to alter the direction of projection, in response to controls signals corresponding to the changing location and direction of the player's head and/or the player's eye, as determined by the processing system in process flow 310. The projection optics may optionally include one or more lenses that affect depth of focus for the projection.

Step 338 determines if there is new directional data. If so, then process flow 330 returns to 334 and sets a new optics direction. This corresponds to the new information gained in step 324 of FIG. 6. If the person's eye has not moved, then process flow 330 checks if there is additional images to be cast (339). If not, then process flow 330 is done. If the person has not moved and video casting continues, new images are created (336) at the current projection optics position. This may include the same video information, or new video information (e.g., animation or other changing video).

Figure 8:
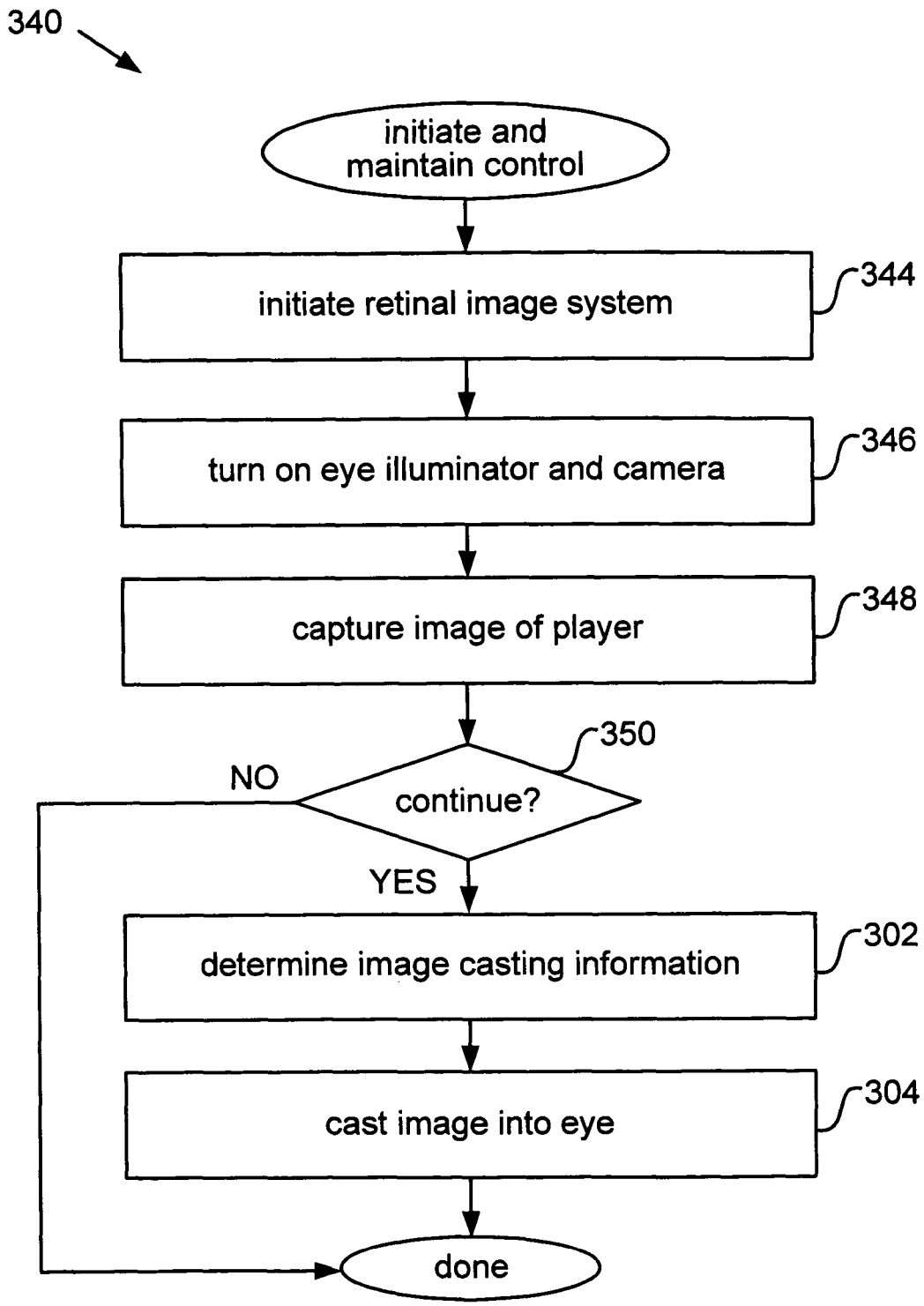
FIG. 8 illustrates a process flow for initiating and maintaining control of a retinal image system in accordance with a specific embodiment of the present invention.

FIG. 8 illustrates a process flow 340 for initiating a retinal image system in accordance with a specific embodiment of the present invention. Process flow includes electronic messages that are sent between a host controller in a gaming machine and a controller for the retinal image system (such as host controller 101 and retinal image system controller 102 of FIG. 2). The host controller maintains priority control, while the retinal image system controller provides feedback messages as requested by the host controller. The host controller may also maintain constant communication transactions with the retinal image system controller even though no image is currently being cast into an eye.

Process flow 340 may begin when a player sits down and begins playing a game at a gaming machine. In this case, the player would have just pressed a button on a front panel of the gaming machine or a button icon on a touch video (LCD) monitor. Alternatively, process flow 340 may begin when a bonus event or a winning outcome occurs on a gaming machine. Regardless of the gaming event, the host controller initiates the retinal image system by sending a wakeup command to the retinal image system controller (344).

In response, the retinal image system may return a response message to the host controller indicating receipt of the initiation command. It may also start initial projection actions. This includes preparation of the light sources and a light valve. The retinal image system controller also turns on the eye illuminator and its corresponding camera (346). In one embodiment, the eye illuminator includes an infrared LED array configured to shine infrared light on a person's eyes when the person is near the gaming machine. A camera then captures one or more images of the eyes (348). In another embodiment, the camera is on continuous capture mode (say for 30 seconds) once enabled.

The host controlled then determines whether to continue (350), e.g., if a player stops playing at the machine or sends a stop command for another reason.

The retinal image controller sends confirmation of eye detection to the host controller (350). If the eyes are detected, the retinal image system controller sends a suitable verification message to the host controller. In addition, the retinal image system controller continues image capture and image processing to continually monitor the position of the person's eye and determining image casting information (FIG. 6). Image projection (FIG. 7) may then proceed for 2-D or 3-D images that are constant or vary over time.

If there is no eye detection after a predetermined time period, then the retinal image system controller a sends a non-verification message to the host controller. The predetermined time period may range from about 2 seconds to about 60 seconds, for example. Other time ranges may be used. The non-verification message conveys that the retinal image system could not find the player's eyes. In response, the gaming machine host controller may display a message on the main video that asks a player to reposition. e.g., so as to enjoy the rental imaging system. The host controller may also prompt the user to input whether or not the person wants to use the retinal image system.

Conventional gaming machines are increasing in size and often require a person to change body and head position to read different screens on a single gaming machine. For example, a main console in the center of the gaming machine may output video information related to a game being played, while a screen in the upper portion of a gaming machine outputs a bonus game. The present invention, however, does not require a player to change body and head position when viewing bonus game information, or any other video information provided in addition to the a game on the main screen.

In some cases, the retinal image system casts an image such that it appears between the person and the main video screen for the gaming machine. For example, an overlay may include a 2-D image cast by the retinal image system that is linearly aligned to intersect with an image on a flat panel monitor included in the gaming machine. As a result, the player may view additional visual information provided by the retinal image system without removing their eyes from a main screen and game played thereon.

In one embodiment, video information cast by the retinal image system includes bonus game information. For example, the retinal image system may cause an interactive bonus game to appear in front of a player, between the player and main screen. The player then makes one or more decisions based on visual information provided by the retinal image system that affect an outcome of a bonus game.

In another embodiment, the retinal image system casts 3-D information into a player's eye. In this case, video information provided to the projection system includes 3-D video information and the projection system dynamically adapts depth of focus to create the perception of a 3-D image. As an illustrative example, IGT of Reno, Nev. provides a Star Wars game on a gaming machine. One exemplary 3-D effect might include generating an image of Princess Leia using the retinal image system, similar to the 3-D image created by R2-D2 in the movie. Leia may linearly overlay with an image of a game being played between the player and gaming machine, and point to a particular bonus future on the video screen. Other graphics, bonus game information and relationships between the retinal image system visual information and main video console may be used.

As mentioned before, entertainment is an important issue with gaming machines; player participation increases with entertainment. Older machines solely relied on sounds and fixed lights. Modern gaming machines employ computer animation, voice, and sophisticated images to increase player entertainment. The present invention expands image creation capabilities for gaming machines. This increases entertainment for many players, and provides gaming machine manufacturers and designers more options in designing entertaining and interactive games.

Figure 9:
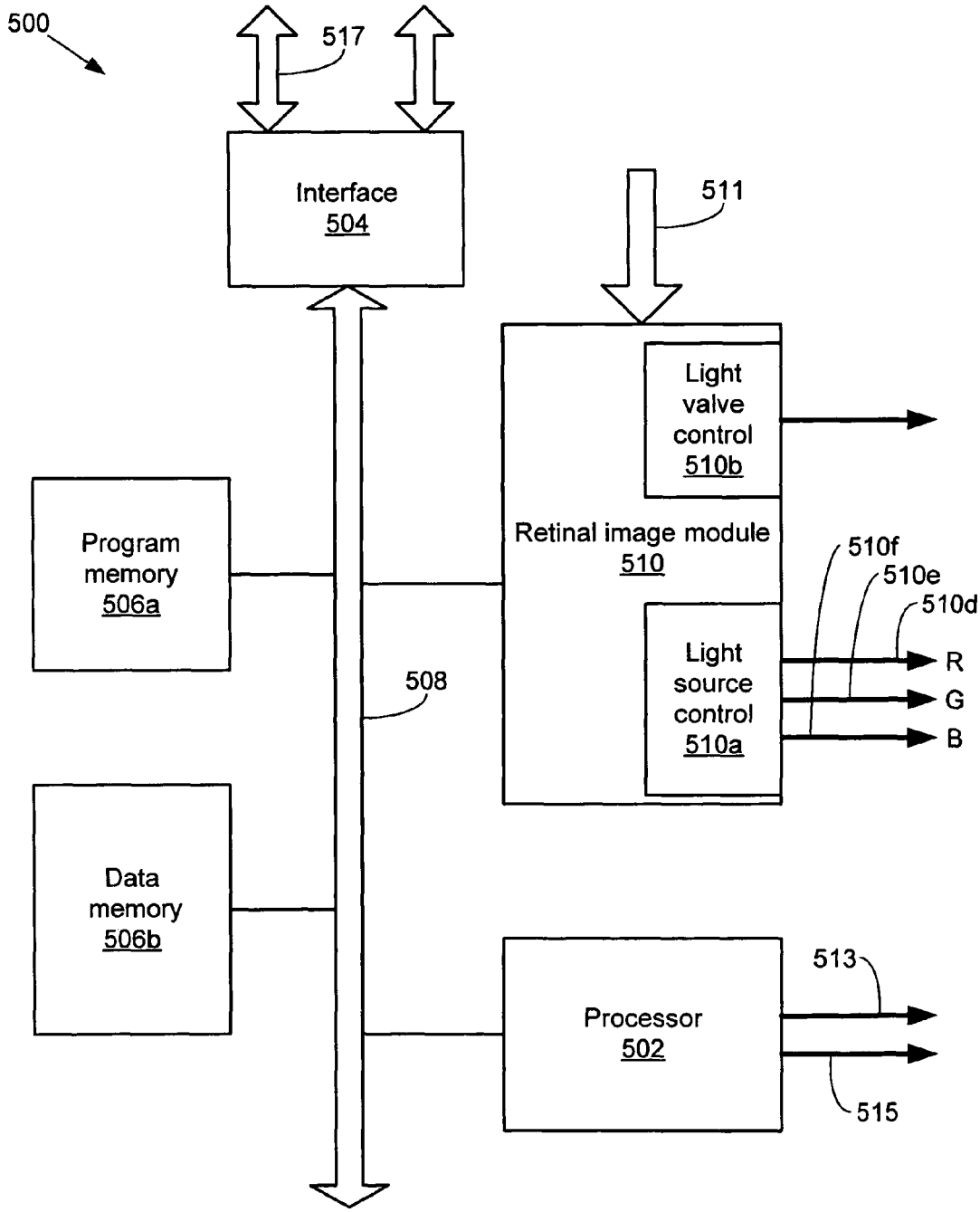
FIG. 9 illustrates an exemplary processing system in accordance with one embodiment of the present invention.

Retinal image scanning as described herein employs some form of processing to determine—and track—eye position of a player. Referring now to FIG. 9, a simplified processing system 500 is shown in accordance with one embodiment of the present invention. Processing system 500 may replace controller 102 shown in FIG. 2. Processing system 500 includes processor 502, interface 504, program memory 506*a*, data memory 506*b*, bus 508, and retinal image module 510.

When acting under the control of appropriate software or firmware, processor (or CPU) 502 implements game play and retinal image scanning functions as described herein. CPU 502 may include one or more processors such as a processor from the Motorola family of microprocessors or the MIPS family of microprocessors. In an alternative embodiment, processor 502 is specially designed hardware for controlling the operations of a gaming machine. In one embodiment, one of memories 506 (such as non-volatile RAM and/or ROM) also forms part of CPU 502. However, there are many different ways in which memory could be coupled to the processing system.

Interfaces 504 control the sending and receiving of data to and from system 500 and may support other peripherals used with system 500. Suitable hardware interfaces and their respective protocols may include USB interfaces, Ethernet interfaces, cable interfaces, wireless interfaces, dial up interfaces, and the like. For example, the USB interfaces may include a direct link to an infrared camera as described above and a direct link to a host processor in a gaming machine. Bus 508 (e.g., a PCI bus) permits digital communication between the various components in system 500.

Retinal image control module 510 outputs control signals to one or more components included in retinal image system 100 (FIG. 2). In one embodiment, control module 510 coordinates timed signals sent to the light source and light valve. In this case, control module 510 includes light source controller 510*a* and light valve control 510*b*. Light source controller 510*a* outputs timed control signals 510*d-f* to red, green and blue laser control components that control on/off timing for each color laser light source 104.

Light valve control 510*b* has several functions. More specifically, light valve control 510*b*: a) receives video data related to 2-D or 3-D video information from an input 511, b) converts the video data into pixilated control signals for light valve 108, and c) outputs the pixilated control signals to the operable control elements for each pixel in the light valve in a timely manner that corresponds to colored light incidence for each pixel. Light valve control 510*b* will vary with a specific light valve 108 used in system 100. In a specific embodiment, light valve 108 includes a digital micromirror device and control 510*b* is configured to communicate with such a device. In this case, control 510*b* provides digital on/off signals that control the position of each mirror included in the array. Each control component 510*a* and 510*b* may include suitable hardware and/or software for providing control signals to its respective hardware.

Processor 502 contributes to control of components included in retinal image system. In the embodiment shown, processor 502 provides control signals to one or more motors used in positioning directional optics 110*b* on line 513. Processor 502 also outputs control signals to eye illuminator 116 on a line 515. Processor 502 additionally provides control signals to camera 114 and receives video data from camera 114 corresponding to image capture using line 517.

In one embodiment, processing system 500 is included in a gaming machine. In this case, processor 502 may represent the main processor or a component control processor included in the gaming machine. In another embodiment, a retinal imaging system includes a separate hardware module installed on a gaming machine that includes its own processing system 500.

Although the system 500 shown in FIG. 9 is one specific processing system, it is by no means the only processing system architecture on which the present invention can be implemented. Regardless of the processing system configuration, it may employ one or more memories or memory modules (e.g., program memory 506*a* and data memory 506*b*) configured to store program instructions for gaming machine network operations and operations associated with retinal image systems described herein. Such memory or memories may also be configured to store player interactions, player interaction information, motion detection algorithms, edge detection algorithms, facial recognition programs and other instructions related to steps described above, instructions for one or more games played on the gaming machine, etc. Memory 506 may include one or more RAM modules, flash memory or another type of conventional memory that stores executable programs that are used by the processing system to control components in the retinal image system.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the foregoing invention has been described in some detail for purposes of clarity of understanding, it will be apparent that certain changes and modifications may be practiced within the scope of the appended claims. For example, although the present invention has been described with respect to a single retinal image system that casts an image into one eye, a gaming machine may include to retinal image systems that casts two images—one each eye for a person. In addition, although retinal image system 100 has been described with respect to use with a commercially available micromirror device, the system may be custom designed to eliminate one or more transmission optics, such as prism 106*c*, achromat lens 106*b*, and mirror 1110*a*, which allows the beam of light to be reflected at an angle (say 45 degrees) to allow the beam of light to be directed at the projection optics 110*b*. Therefore, the present examples are to be considered as illustrative and not restrictive, and the invention is not to be limited to the details given herein, but may be modified within the scope of the appended claims.

What is claimed is:

1. A gaming machine comprising:

an external cabinet defining an interior region of the gaming machine, the external cabinet adapted to house a plurality of gaming machine components within or about the interior region;

an eye detection system located within or about the external cabinet, the eye detection system configured to do the following:

locate an eye position of a person near the gaming machine;

generate corresponding image casting information that describes the eye position relative to a position of the gaming machine such that an image may be projected from the gaming machine to a retina of the person near the gaming machine;

track the eye position; and generate updated image casting information according to a predetermined refresh rate; and a retinal image system located within or about the external cabinet, the retinal image system comprising a projection system, the retinal image system configured to do the following:

generate the image for the person;

receive image casting information, including updated image casting information, from the eye detection system;

project, via the projection system, the image onto the retina using the image casting information, the projected image being confined to an area of the person's eyes; and change a direction of image projection according to the updated image casting information.

2. The gaming machine of claim 1 wherein the eye detection system includes a camera configured to capture an image that includes the eye when the person is playing a game on the gaming machine.

3. The gaming machine of claim 2 wherein the eye detection system includes an eye illuminator located within or about the external cabinet and configured to direct light towards the person while the person plays the game.

4. The gaming machine of claim 3 wherein the eye illuminator directs infrared light towards the person.

5. The gaming machine of claim 3 wherein the eye detection system includes a processing system that is configured to locate the eye using information captured in the image.

6. The gaming machine of claim 3 wherein the eye illuminator and the camera are located within six inches of each other.

7. The gaming machine of claim 3 wherein the eye illuminator is located in a central horizontal position relative to a video display included in the gaming machine.

8. The gaming machine of claim 1 wherein the eye detection system constructs a tracking zone that estimates where the person will be relative to the gaming machine when playing a game on the gaming machine.

9. The gaming machine of claim 1 wherein the retinal image system comprises:

one or more light sources that generate light;

a light valve configured to produce an image by selectively transmitting light according to video information;

transmission optics configured to receive light from the one or more light sources and transmit light to the light valve.

10. The gaming machine of claim 9 wherein the one or more light sources comprise a set of lasers.

11. The gaming machine of claim 10 wherein the set of lasers includes a diode laser.

12. The gaming machine of claim 9 wherein the projection system includes directing optics that are configured to direct the image toward the eye.

13. The gaming machine of claim 12 further comprising a controller configured to provide control signals to an actuator that positions the directing optics.

14. The gaming machine of claim 12 wherein the projection system is configured to raster scan the image into the eye of the player.

15. The gaming machine of claim 1 wherein the retinal image system outputs less than about 1 milliwatt of light.

16. A gaming machine comprising:

an external cabinet defining an interior region of the gaming machine, the external cabinet adapted to house a plurality of gaming machine components within or about the interior region;

an eye detection system located within or about the external cabinet, the eye detection system configured to do the following:

locate an eye position of a person near the gaming machine;

generate corresponding image casting information that describes the eye position relative to a position of the gaming machine such that an image from the gaming machine may be projected to a retina of the person near the gaming machine;

track the eye position; and generate updated image casting information according to a predetermined refresh rate; and a retinal image system located within or about the external cabinet. The retinal image system configured to receive image casting information, including updated image casting information, from the eye detection system, the retinal image system including:

one or more light sources that generate light;

a light valve configured to produce an image by selectively transmitting light according to video information, and a projection system configured to do the following:

receive the image from the light valve;

project the image onto the retina of the person using the image casting information, the projected image being confined to an area of the person's eyes; and change a direction of image projection according to the updated image casting information.

17. The gaming machine of claim 16 further comprising transmission optics configured to receive light from the one or more light sources and transmit the light to the light valve.

18. The gaming machine of claim 16 wherein the eye detection system includes a camera configured to capture an image that includes the eye of the person when the person is near the gaming machine.

19. The gaming machine of claim 18 wherein the eye detection system includes an eye illuminator located within or about the external cabinet and configured to direct light towards the person while the person plays a game on the gaming machine.

20. The gaming machine of claim 19 wherein the eye illuminator directs infrared light towards the person.

21. The gaming machine of claim 20 further comprising a processing system configured to locate the eye using information captured in the image.

22. The gaming machine of claim 16 wherein the one or more light sources comprises a set of lasers.

23. The gaming machine of claim 16 wherein the projection system is configured to raster scan the image into the eye of the player.

24. The gaming machine of claim 16 wherein the retinal image system outputs less than about 1 milliwatt of light.

25. A gaming machine comprising:

an external cabinet defining an interior region of the gaming machine, the external cabinet adapted to house a plurality of gaming machine components within or about the interior region;

apparatus for determining a person's identity;

an eye detection system located within or about the external cabinet and including:

a camera configured to capture an image that includes a person's eye when the person is near the gaming machine, and a processing system configured to do the following:

determine a current eye position relative to a position of the gaming machine, using information captured in the image, such that an image may be projected from the gaming machine to a retina of the person near the gaming machine;

control the camera to track the eye position; and generate image casting information indicating the current eye position; and a retinal image system located within or about the external cabinet, the retinal image system comprising a projection system, the retinal image system configured to do the following:

receive the image casting information;

generate an image for the person, the image corresponding with the person's identity;

direct, via the projection system, the image onto the person's retina using the image casting information, the directed image being confined to an area of the person's eyes.

26. The gaming machine of claim 25 further comprising an eye illuminator located within or about the external cabinet and configured to direct light towards the person while the person plays the game on the gaming machine.

27. The gaming machine of claim 25 wherein the eye illuminator directs infrared light towards the person.

28. The gaming machine of claim 25 wherein the retinal image system outputs less than about 1 mW of light.

29. A method, comprising:

determining an identity of a person near a wager gaming machine;

repeatedly determining a current eye position of the person relative to a position of the wager gaming machine such that an image may be projected from the gaming machine to a retina of the person;

producing an image that corresponds with the identity of the person; and directing the image onto the retina of the person according to the current eye position using a retinal image system incorporated into the gaming machine, the retinal image system comprising a projection system configured to receive the image and transmit the image toward the eye of the person, the directed image being confined to an area of the person's eyes.

30. The method of claim 29 wherein the portion of the gaming machine refers to a projection component of a retinal image system included in the gaming machine.

31. The method of claim 29 further comprising locating a pupil of the person within the eye.

32. The method of claim 29 further comprising determining a position of a head for the person relative to the gaming machine and changing location of the eye based on the head position.

33. The method of claim 32 wherein determining the position of the head includes determining a tilt or rotation of the head.

34. The method of claim 29 further comprising capturing an image of the person using a camera.

35. The method of claim 34 further comprising shining infrared light on the person.

36. The method of claim 29 wherein the eye is located when the person touches a button or video screen included with the gaming machine.

37. The method of claim 29 further comprising detecting the person when the person is near the gaming machine.

38. The method of claim 29 further comprising defining a tracking zone in which the eye is expected to be located when the person plays a game on the gaming machine.

39. The method of claim 38 wherein the tracking zone estimates a position of the person's head while sitting in front of the gaming machine.

40. The method of claim 38 wherein the tracking zone estimates that the person is within arm's reach of the gaming machine.

41. The method of claim 38 wherein the tracking zone uses ergonomic information to determine size for the tracking zone.

42. The method of claim 38 wherein the tracking zone includes three dimensions.

43. The method of claim 29 wherein the retinal image system casts the image such that it linearly overlays with a main video screen for the gaming machine.

44. The gaming machine of claim 1, wherein the retinal image system is configured to detect entry of the person into a tracking zone to play a game on the gaming machine.

45. The gaming machine of claim 1, wherein the retinal image system is configured to initiate the generation of the image upon occurrence of a bonus event or a winning outcome on the gaming machine.

* * * * *